US007380927B2

(12) United States Patent
Shigemura

(10) Patent No.: US 7,380,927 B2
(45) Date of Patent: Jun. 3, 2008

(54) INK JET RECORDING APPARATUS

(75) Inventor: Yoshihiro Shigemura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 400 days.

(21) Appl. No.: 11/300,085

(22) Filed: Dec. 14, 2005

(65) Prior Publication Data

US 2006/0139419 A1 Jun. 29, 2006

(30) Foreign Application Priority Data

Dec. 28, 2004 (JP) ..... 2004-379952

(51) Int. Cl.
*B41J 2/18* (2006.01)
*B41J 2/05* (2006.01)
*B41J 2/175* (2006.01)

(52) U.S. Cl. ..... 347/89; 347/65; 347/85

(58) Field of Classification Search ..... 347/20, 347/56, 65, 66, 84, 85, 89, 92
See application file for complete search history.

(56) References Cited

U.S. PATENT DOCUMENTS 4,614,948 A * 9/1986 Katerberg et al. ..... 347/89
4,896,172 A 1/1990 Nozawa et al.
5,341,162 A * 8/1994 Hermanson et al. ..... 347/92
5,561,448 A * 10/1996 Kaneko et al. ..... 347/29
5,793,395 A * 8/1998 Tanaka et al. ..... 347/85
5,943,078 A * 8/1999 Nishimoto et al. ..... 347/89
6,817,705 B1 * 11/2004 Crockett et al. ..... 347/85

FOREIGN PATENT DOCUMENTS

JP 05-17712 1/1993
JP 2000-255048 9/2000

* cited by examiner

*Primary Examiner*—Anh T. N. Vo
(74) *Attorney, Agent, or Firm*—Canon USA Inc I.P.Div

(57) ABSTRACT

A liquid jet recording apparatus includes a liquid jet head including discharge ports, element substrates, a base substrate, common liquid chambers, and a head liquid chamber. The apparatus also includes a first liquid supply path that leads from a liquid reserve tank to a liquid indraft orifice provided on the base substrate via a pump, a second liquid supply path that leads from a liquid outflow orifice provided on the base substrate to a sub-tank, a third liquid supply path that leads from the sub-tank to a liquid indraft orifice provided on the head liquid chamber, a fourth liquid supply path that leads from a liquid outflow orifice provided on the head liquid chamber to the liquid reserve tank or the sub-tank, and a fifth liquid supply path that leads from the sub-tank to the liquid reserve tank to return the liquid from the sub-tank to the liquid reserve tank.

8 Claims, 18 Drawing Sheets

112
114
108
107
101
107
101
107
101

INK JET RECORDING APPARATUS

BACKGROUND OF THE INVENTION

1. Field of the Invention

The present invention relates to a liquid jet recording apparatus.

More specifically, the present invention relates to a liquid jet recording apparatus using a full-line type recording head that has a discharge port array with a length substantially equal to the width of a recording medium and that carries out image recording onto substantially the whole surface of a recording medium by relatively scanning the recording medium with the recording head for only one time.

Even more specifically, the present invention relates to a liquid jet recording apparatus that supplies ink to the head from a second tank that is different from a liquid reserve tank.

2. Description of the Related Art

Conventionally, in a liquid jet head that discharges an ink droplet by utilizing thermal energy such as heat generated by a heater and the like, some of the thermal energy generated by the heater is discharged to the outside of the head by the discharge of the ink droplet.

However, in some cases, the remaining thermal energy is stored in the liquid jet head, so that the temperature of the liquid jet head is raised.

Due to the rising of the temperature of the liquid jet head, the ink in the head is more intensely heated.

On the other hand, the viscosity of the ink is reduced as the temperature of the head is raised. Thus, in the case of the ink with reduced viscosity, a larger amount of ink is discharged even when the energy of the same level as compared to the case of an ink having a viscosity of a normal level is applied.

In addition, the temperature of the head is raised as the number of copies to be printed increases. Therefore, there is a problem such that in this case, the density of an image is gradually increased.

In addition, when the temperature of the head is raised, air dissolving in the ink supplied to the head is separated out. Then, the separated-out air is accumulated, and as a result, the ink is not supplied to the discharge ports in a sufficient amount. Thus, there occurs phenomena of an instability of a discharge operation and a discharge failure in the worst case.

An effect of the rise in the temperature appears more remarkable in a recording apparatus using a long full-line type head that has a large number of nozzles distributed in a high density and that carries out recording onto substantially the whole surface of the recording medium by a single relative movement of the head and the recording medium.

In this type of conventional liquid jet recording apparatus, an excellent image is obtained by cooling the full-line type head in order to prevent the temperature rise of the head.

In recent years, the trend for higher definition and higher printing speed of a liquid jet recording apparatus is getting more and more developed. With regard to resolution, for example, the trend is transited from 1,200 dpi to 2,400 dpi, and then to 4,800 dpi. As is known from this, a product of a higher resolution is brought out to the market year by year.

In accordance with the improvement of the resolution, an ink droplet discharged by one discharge operation is getting smaller and smaller in size. In this regard, at present times, there is a product that is capable of discharging a very small ink droplet of 2 pl.

However, as the resolution becomes higher, it is necessary to make a discharging frequency higher in accordance with the higher resolution. Thereby, the temperature rise of the liquid jet head becomes much greater.

In the case of a recording apparatus using a full-line type liquid jet head that carries out printing by only one relative movement (single pass) of a recording medium and the recording head, an image is finally formed by one relative movement of the recording medium and the recording head.

However, there is a problem such that it is impossible to decrease the number of ink discharge nozzles used at the same time to a submultiple of the number of nozzles by carrying out the image formation by distributing the operation into multiple passes as in the case of a serial type recording apparatus that forms an image by reciprocating movement of the head.

In a case where the recording by a single pass by the full-line type head is finally carried out, it is necessary to use the whole portion of the head in the single pass. Therefore, the rise in the temperature of the head caused by continuous printing becomes more remarkable.

Practically, in order to implement high speed printing by which 60 sheets of A4 size paper are fed per one minute in the direction of a shorter side of the paper (in a horizontal direction), a discharge frequency of the head of 16 kHz is necessary for the resolution of 1,200 dpi.

When the resolution is doubled to 2,400 dpi, a discharge frequency of the head of 32 kHz is necessary. In other words, when the resolution becomes high and the size of the ink droplet is made smaller in accordance with the higher resolution, it is necessary to increase the number of ink droplets to be discharged per unit area.

Therefore, in the conventional recording apparatus, in order to implement high speed printing, it is necessary to increase the ink discharge frequency to a large extent. As a result, the intense rise in the temperature of the head is caused.

In the recording apparatus using the full-line type head, the head itself is long, and accordingly, a temperature distribution in the head is likely to occur.

Especially, in the vicinity of an ink supply port through which ink flows into the head in order to replenish ink in an amount equal to an amount of the discharged ink, the ink of a low temperature flows in, and therefore, the temperature is relatively lowered. On the other hand, in a portion distant from the ink supply port, the ink that is heated to some extent in the head is supplied to the nozzle, and therefore, the temperature is raised. Thus, there is a problem such that the temperature distribution is caused in the same head, and the printing density becomes uneven.

In a recording apparatus disclosed in Japanese Patent Application Laid-Open No. 2000-255048, as shown in FIG. 14 and FIG. 15, one end of an ink supply path to a head 1 is connected to an ink cartridge 3, and the other end of the ink supply path is connected to a sub-tank 4.

A pipe-like circuit in the head 1 is filled with ink. When an amount of consumed ink reaches a given amount during printing, the ink is automatically supplied from the ink cartridge 3 to the head 1, and the ink passes through the pipe-like circuit in the head 1 and is then returned to the sub-tank 4.

However, a timing at which the ink is supplied to the head 1 is determined in advance. In a case where a continuous printing at a high resolution is carried out by a full multi-head, the ink supply for offsetting the rise in the temperature cannot be implemented, and it is not possible to carry out a sufficient cooling of the head.

In addition, ink is directly supplied from the ink cartridge 3 into the head 1, and, thereby, a liquid level of the ink cartridge 3 fluctuates. Therefore, the recording apparatus of this type is liable to be directly affected by the fluctuation of a head difference between the liquid levels of the ink cartridge 3 and an ink discharge section.

In a recording apparatus disclosed in U.S. Pat. No. 4,896,172, which is a second conventional example, a liquid jet recording apparatus provided with a switching unit configured to be capable of switching between an ink supply system and an ink circulation system is discussed.

As shown in FIG. 16 and FIG. 17, a heating element 35, a common liquid chamber 33, a recording liquid supply port 36A, and a second supply port 36B used at the time of the circulation of the liquid are provided on an element substrate.

A recording head 31 includes a liquid path 34 and an orifice 32.

Further, the head 31 is provided with a cooling chamber 39 formed on the element substrate in a manner opposed to the liquid path 34, a temperature sensor 38, an ink supply port 310A for supplying the liquid to the cooling chamber 39, and a liquid return port 310B.

In the recording apparatus disclosed in U.S. Pat. No. 4,896,172, the rise in the temperature in the head 31 is detected by the temperature sensor 38. If the temperature is above a certain given level as a result of the detection, the switching unit switches the ink supply path. That is, the ink is circulated between a recording liquid reserve tank 37 and the head 31 in order to cool the head 31, as indicated by full line arrows shown in FIG. 18.

The liquid circulation path is constituted by valves 314, 315A, and 315B, pumps 313, 314A, 325A, and 325B, the recording liquid reserve tank 37, liquid supply paths 312B and 312A, and liquid return paths 311A and 311B.

However, in the configuration of the recording apparatus disclosed in U.S. Pat. No. 4,896,172, it is necessary to switch the ink supply path by the switching unit in carrying out the cooling of the head.

That is, in a case where continuous printing is carried out by a liquid jet recording apparatus using a full-line type liquid jet head capable of high speed printing, there is a problem such that a capacity of cooling the head is not high enough.

SUMMARY OF THE INVENTION

The present invention is directed to a liquid jet recording apparatus capable of reducing a temperature rise in a liquid jet head and a temperature distribution in the liquid jet head even in a case where a full-line type ink jet head is used and a high-resolution or high-speed printing operation is continuously being carried out.

The present invention is further directed to provide a liquid jet recording apparatus that enables a steady ink supply to a full-line recording head, in which poor printing does not occur.

In one aspect of the present invention, a liquid jet recording apparatus includes a liquid jet head including discharge ports configured to discharge liquid, a plurality of element substrates each of which is provided with a plurality of energy generating elements configured to apply kinetic energy to the liquid, a base substrate configured to support the plurality of element substrates, a plurality of common liquid chambers provided in the base substrate correspondingly with the plurality of element substrates, and a head liquid chamber provided opposite to the plurality of element substrates across the base substrate and configured to supply the liquid to be discharged to the plurality of common liquid chambers, wherein the base substrate includes an in-substrate liquid path that is not communicated with the plurality of common liquid chambers and that has a liquid indraft orifice and a liquid outflow orifice, and wherein the head liquid chamber has at least a liquid indraft orifice and a liquid outflow orifice for the liquid to be discharged, a liquid reserve tank and a sub-tank configured to reserve the liquid to be supplied to the liquid jet head, a first liquid supply path that leads from the liquid reserve tank to the liquid indraft orifice provided on the base substrate via a pump and, a second liquid supply path that leads from the liquid outflow orifice provided on the base substrate to the sub-tank, a third liquid supply path that leads from the sub-tank to the liquid indraft orifice provided on the head liquid chamber of the liquid jet head, a fourth liquid supply path that leads from the liquid outflow orifice provided on the head liquid chamber of the liquid jet head to one of the liquid reserve tank and the sub-tank, and a fifth liquid supply path that leads from the sub-tank to the liquid reserve tank and that is configured to return the liquid from the sub-tank to the liquid reserve tank when a predetermined amount or more of the liquid is supplied from the liquid reserve tank to the sub-tank via the pump.

Further, the liquid jet recording apparatus may include a liquid circulation device configured to continuously allow the liquid reserved in the sub-tank to flow from the liquid indraft orifice of the head liquid chamber to the liquid outflow orifice thereof, wherein the liquid circulation device is capable of continuously circulating the liquid in the head liquid chamber even while the liquid jet head is carrying out a liquid jet operation.

In addition, the liquid jet recording apparatus may employ a configuration such that an amount of circulation of the liquid circulated by the liquid circulation device is one of 5 ml/min or more, 10 ml/min or more, and 15 ml/min or more.

In addition, the liquid jet recording apparatus may employ a configuration such that the pump for drawing the liquid from the liquid reserve tank into the sub-tank is constantly operated while the liquid jet head carries out the liquid discharge operation.

In addition, the liquid jet recording apparatus may further include a de-aerating device provided in one of the first ink supply path and the second ink supply path.

In addition, the liquid jet recording apparatus may further include a liquid cooling device provided in one of the second ink supply path and the third ink supply path.

In addition, the liquid jet recording apparatus may have a configuration such that the plurality of element substrates are disposed on the base substrate in a staggered fashion.

In addition, the liquid jet recording apparatus may have a configuration such that an array of the discharge ports of the liquid jet head has a length substantially equal to the width of a recording medium.

As described above, according to the present invention, advantageous effects as described below can be obtained.

Ink can flow from the liquid reserve tank into the in-substrate liquid path provided in the base substrate of the liquid jet head even while the liquid jet head is currently carrying out the liquid jet operation.

In addition, a liquid jet recording apparatus can be provided that is capable of reducing a rise in the temperature of the head and a temperature distribution in the head even if continuous printing is carried out with a long full-line type head.

In addition, ink can flow from the sub-tank into the head liquid chamber provided in a head liquid chamber member that is provided as a supply path for ink for printing.

Thus, it is possible to alleviate the effect on the discharge ports caused by fluctuation in the liquid level of a main tank with a great head difference with respect to an ink discharge section. Accordingly, a liquid jet recording apparatus can be provided that is capable of printing a high-quality image by stably supplying ink to the head.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE EMBODIMENTS

Exemplary embodiments of the present invention will be described in detail below with reference to the drawings.

First Embodiment

To begin with, a head configuration of a liquid jet recording apparatus according to a first embodiment of the present invention is described with reference to FIG. 2 through FIG. 7.

Figure 2:
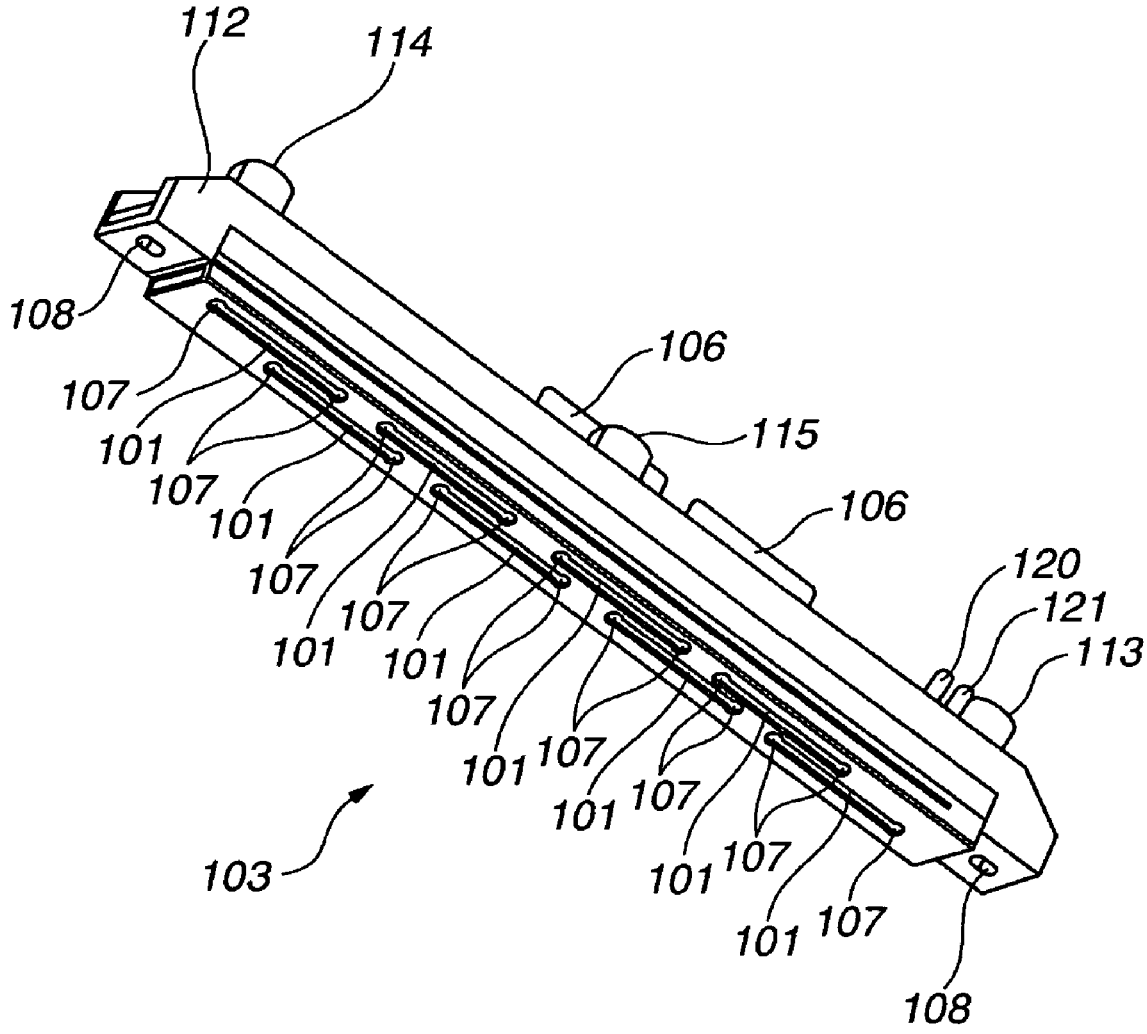
FIG. 2 is a perspective view of an ink jet head of the ink jet recording apparatus according to the first embodiment of the present invention as viewed from a head element substrate side.
Figure 3:
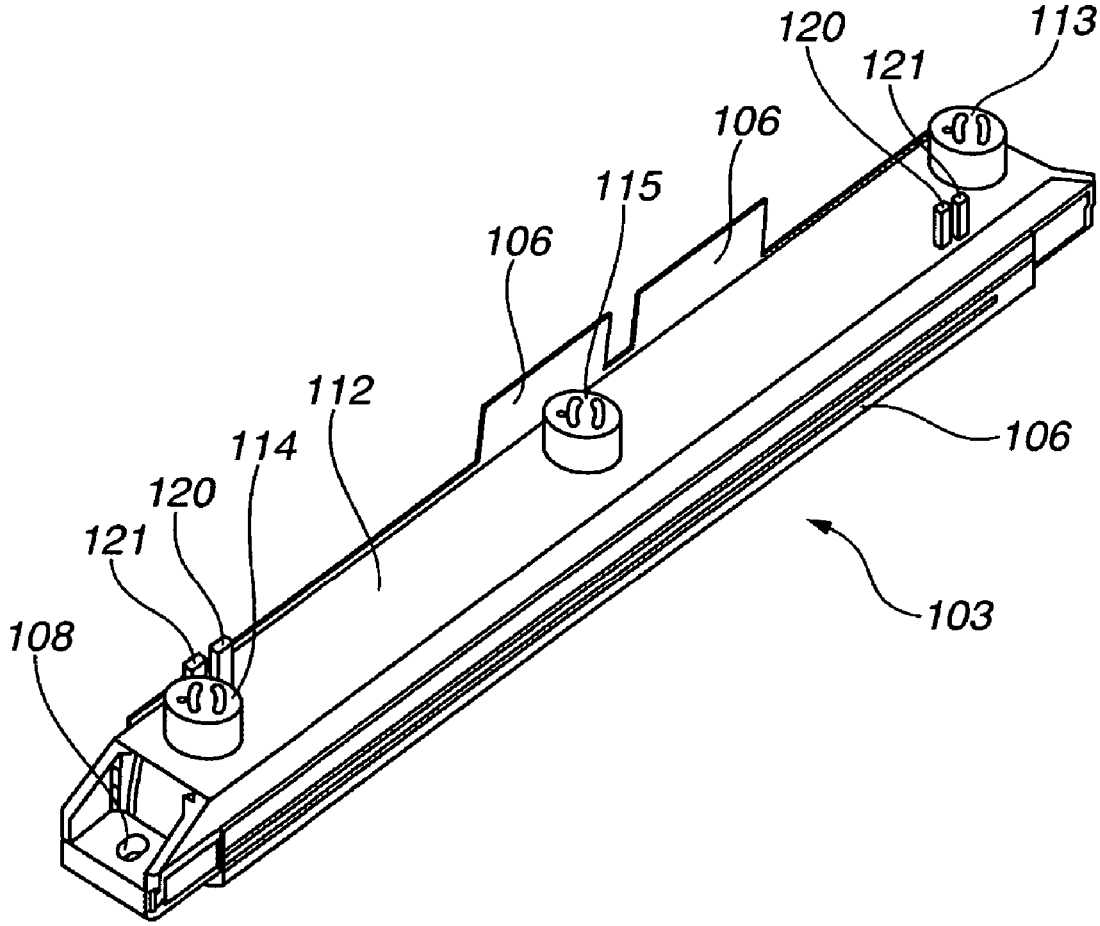
FIG. 3 is a perspective view of the ink jet head of the ink jet recording apparatus according to the first embodiment of the present invention as viewed from a liquid supply port side.
Figure 4:
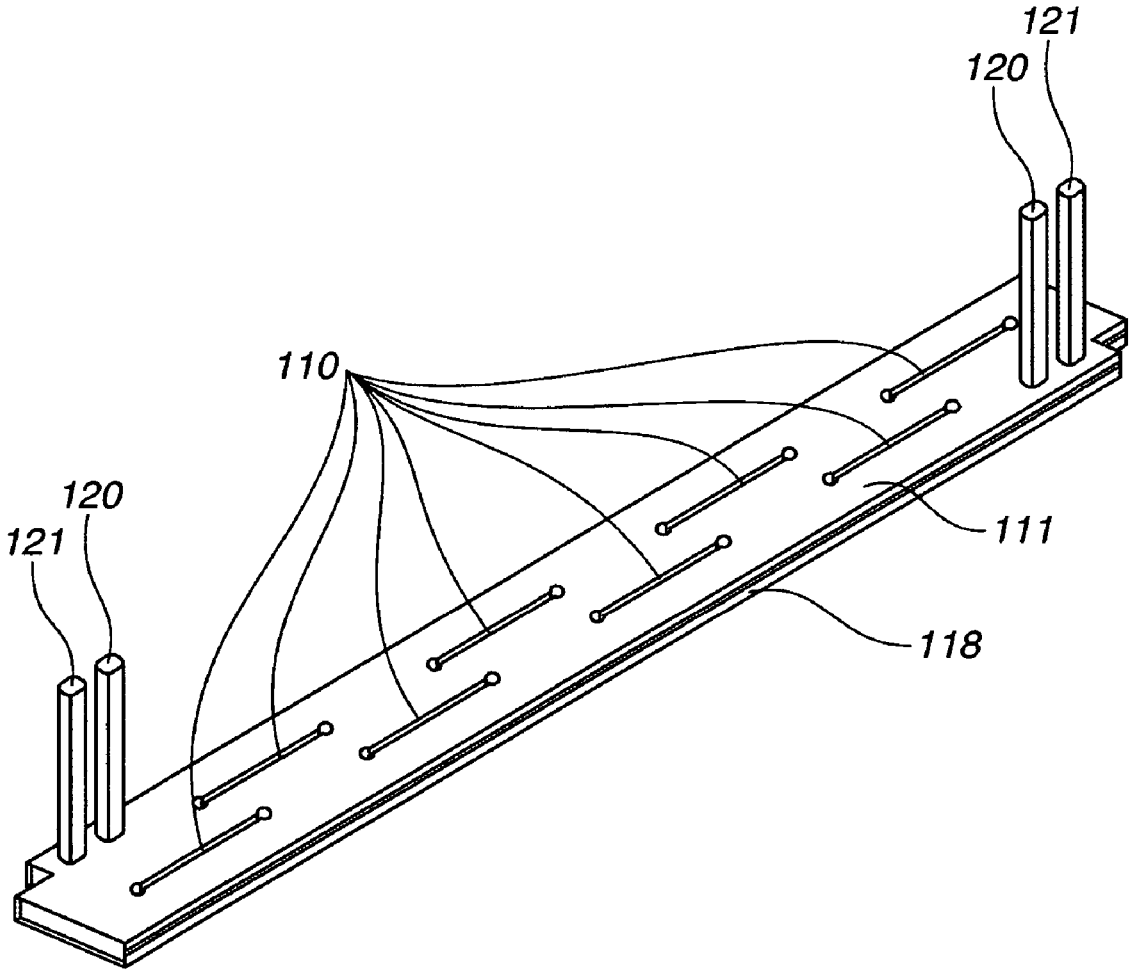
FIG. 4 is a perspective view explaining a base substrate of the head of the ink jet recording apparatus according to the first embodiment of the present invention.
Figure 5:
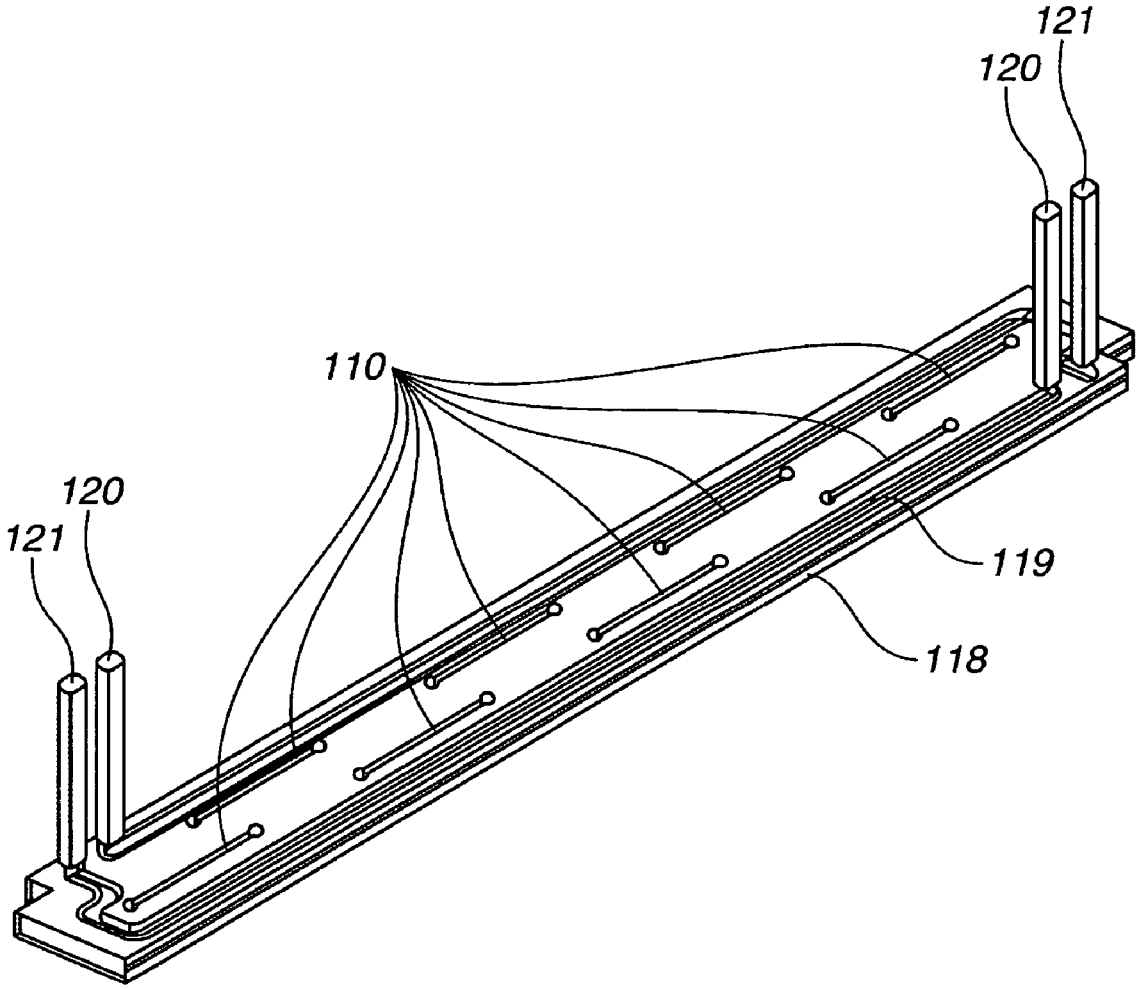
FIG. 5 is a perspective view explaining the base substrate of the head of the ink jet recording apparatus according to the first embodiment of the present invention.
Figure 6A:
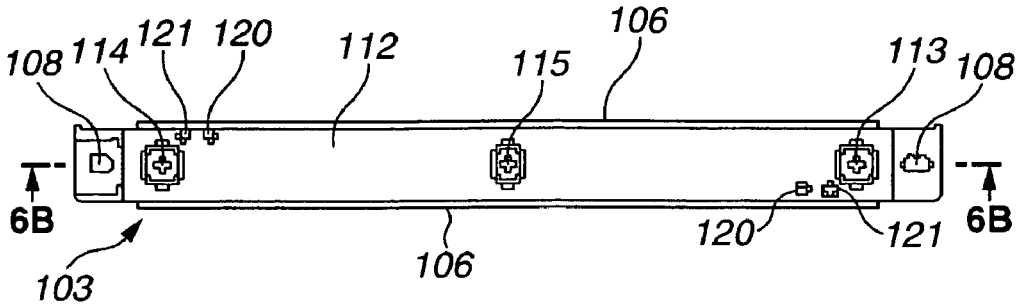
FIG. 6A is a front view of the ink jet head according to the first embodiment of the present invention as viewed from a liquid supply port side.
Figure 6B:
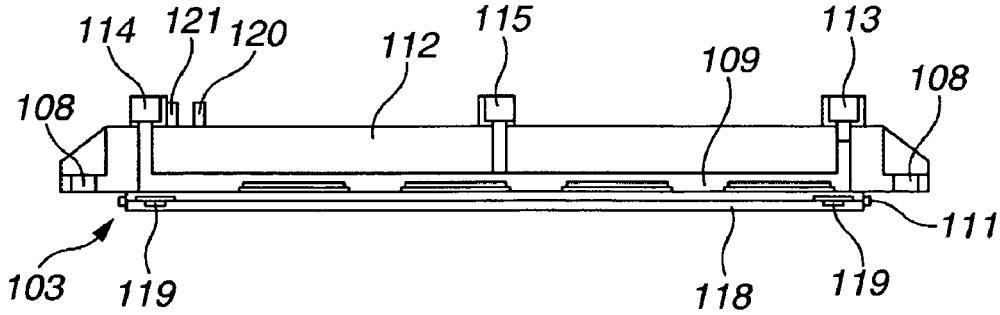
FIG. 6B is a cross sectional view taken along line 6B-6B of FIG. 6A.
Figure 6C:
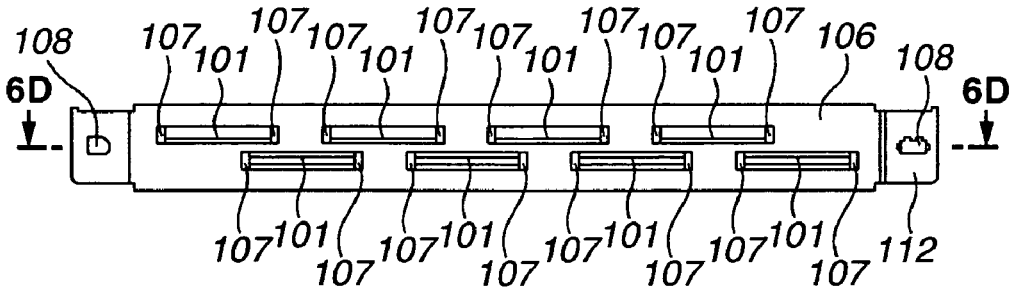
FIG. 6C is a front view of the ink jet head according to the first embodiment of the present invention as viewed from a flexible wiring board side.
Figure 6D:
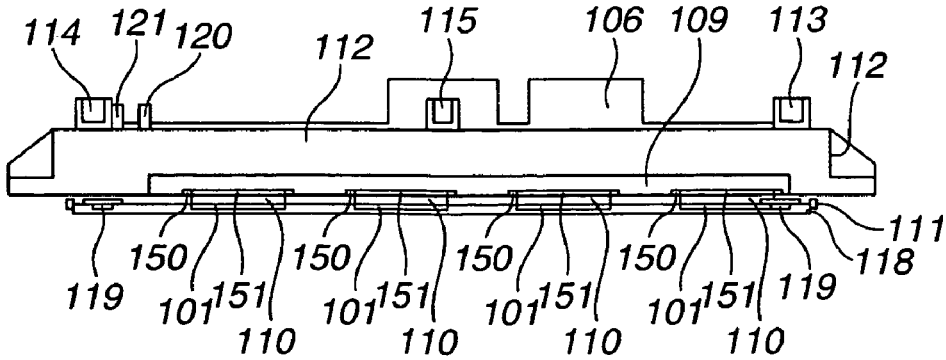
FIG. 6D is a cross sectional view taken along line 6D-6D of FIG. 6C.
Figure 7:
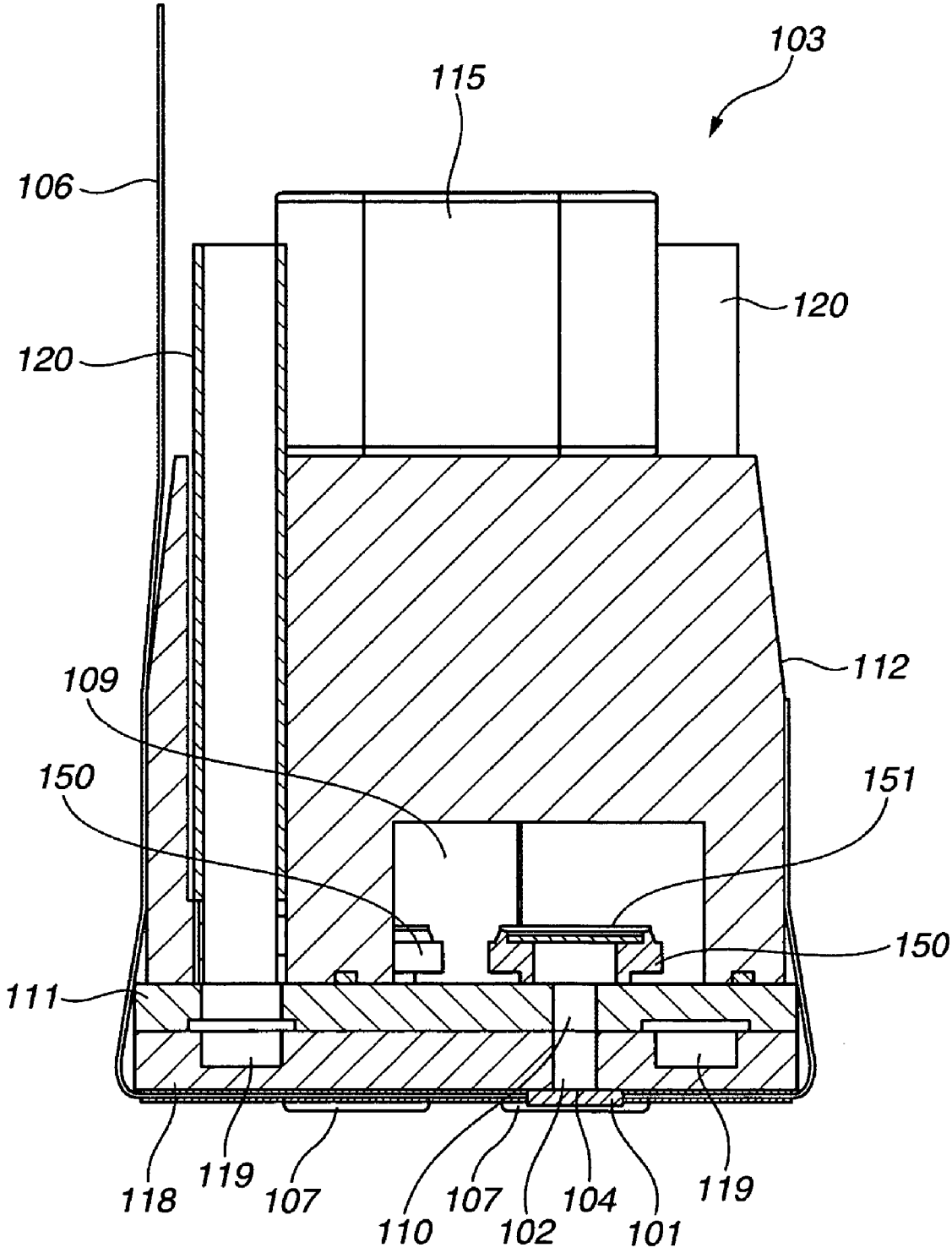
FIG. 7 is a side cross sectional view of the ink jet head according to the first embodiment of the present invention.

FIG. 2 and FIG. 3 are perspective views showing an ink jet head viewed from the side of a head substrate element and viewed from the side of a liquid supply port, respectively. FIG. 4 and FIG. 5 are views explaining a detailed structure of a base substrate of the head, respectively. FIG. 6A is a front view showing the ink jet head according to the first embodiment of the present invention when viewed from the side of a liquid supply port. FIG. 6B is a cross sectional view taken along line 6B-6B of FIG. 6A. FIG. 6C is a front view showing the ink jet head according to the first embodiment of the present invention when viewed from the side of a liquid discharge port. FIG. 6D is a cross sectional view taken along line 6D-6D of FIG. 6C. FIG. 7 is a side cross sectional view showing the details of the ink jet head.

A liquid jet head 103 according to the present embodiment includes, as shown in FIG. 2 through FIG. 7, eight element substrates 101 each having an effective discharge width of about one inch. The eight element substrates 101 are bonded to a lower base substrate 118, which is a supporting member, in a staggered state.

Further, electrode sections disposed at both ends of the element substrate 101 are electrically connected to a flexible wiring board 106 by wire bonding.

A liquid jet head 103 has an effective discharge width of about eight inches, and the effective discharge width is substantially equal to the shorter side length of a recording paper sheet of A4 size. In other words, the liquid jet head 103 is a liquid jet head having a length with which it is possible to carry out continuous printing by one pass in the case of a vertical feeding of the A4 size recording paper sheet. The liquid jet recording apparatus is provided with the same liquid jet head for each color and is capable of carrying out full color printing.

With respect to an actual recording operation, the recording is carried out with a droplet of liquid discharged by each of a plurality of discharge ports 102 (shown in FIG. 7) for discharging the liquid. The discharge ports 102 are opened on the front surface side of the element substrate 101 in the vicinity of a central portion of the element substrate 101.

The element substrate 101 has a heating element (an electrothermal converting element or a heater) (not shown)

as a discharge energy generation element, corresponding to each of the discharge ports 102, that is formed on the element substrate 101.

The heating element, when energized, forms bubbles in the liquid by heating the liquid, and allows the liquid to be discharged from the discharge ports 102 by kinetic energy generated by the bubbling of the liquid.

In a wire bonding section that connects the electrode section of the element substrate 101 and the flexible wiring substrate 106, droplets scattering from the discharge ports 102 or droplets bouncing from the surface of a recording medium may adhere to the electrode section and the like.

Therefore, in order to prevent corrosion of the electrodes and base metal of the electrodes from occurring, the electrodes of the element substrate 101 are covered and sealed with a sealer 107 made of silicon resin and the like of high sealing capability and high ion shielding capability, so as not to cause deterioration of a connection reliability due to the liquid.

In addition, a filter member 151 is attached onto the back surface side of the element substrate 101 via a filter supporting member 150, as shown in FIG. 6D and FIG. 7. The filter member 151 is configured by a woven stainless extra fine wire so that a foreign material having a particle diameter large enough to clog the discharge ports 102 does not pass through the discharge ports 102.

In the present embodiment, the filter member 151 having a mesh capable of avoiding passage of a foreign material with a diameter of about 10 μm or more is used. For all of the element substrates 101, the same filter supporting member 150 and the same filter member 151 are mounted.

The filter member 151 has an area large enough to prevent a large pressure loss with respect to a maximum liquid flow in a case where all discharge nozzles carry out the liquid discharge operation with one element substrate 101.

If the filter member 151 has a small area and the pressure loss at the filter member 151 at the time of the maximum liquid flow is large, the liquid is not supplied to the discharge ports 102 in a sufficient amount.

That is, in this case, an amount of liquid discharged in one discharge operation is reduced, and consequently, the density is reduced and discharge failure occurs at the time of printing.

In addition, as shown in FIG. 6D and FIG. 7, an upper base substrate 111 is provided with a slit-like aperture section. The slit-like aperture section of the upper base substrate 111 is formed in a one-to-one correspondence with each element substrate 101 and serves as a common liquid chamber 110 for retaining the liquid.

The upper base substrate 111 and the lower base substrate 118 are provided with an in-substrate liquid path 119 in the vicinity of the common liquid chamber 110 so as not to be communicated with the common liquid chamber 110.

The common liquid chamber 110 is opened with a longitudinal dimension substantially equal to the length of an array of the discharge ports 102. In addition, the element substrate 101 is provided with a tapered slit 104 for supplying the liquid in the common liquid chamber 110 on the back surface side of the element substrate 101 to the front surface side of the element substrate 101.

Adjacent to the common liquid chamber 110, the filter supporting member 150 and the filter member 151 are located on the side opposed to the element substrate 101 in relation to the upper base substrate 111. The filter supporting member 150 and the filter member 151 form the common liquid chamber 110 together with the upper base substrate 111.

Onto the side of the upper base substrate 111 on which the filter member 151 is bonded, a head liquid chamber member 112 is bonded. The head liquid chamber member 112 covers all of the filter members 151 bonded correspondingly with each element substrate 101, and forms a head liquid chamber 109.

As shown in FIG. 6A, FIG. 6B, and FIG. 6D, at portions near both ends of the head liquid chamber member 112, liquid outflow orifices 113 and 114 are provided so as to be communicated with the head liquid chamber 109. In addition, a liquid indraft orifice 115 is provided at an approximate center portion between the liquid outflow orifices 113 and 114.

Figure 1:
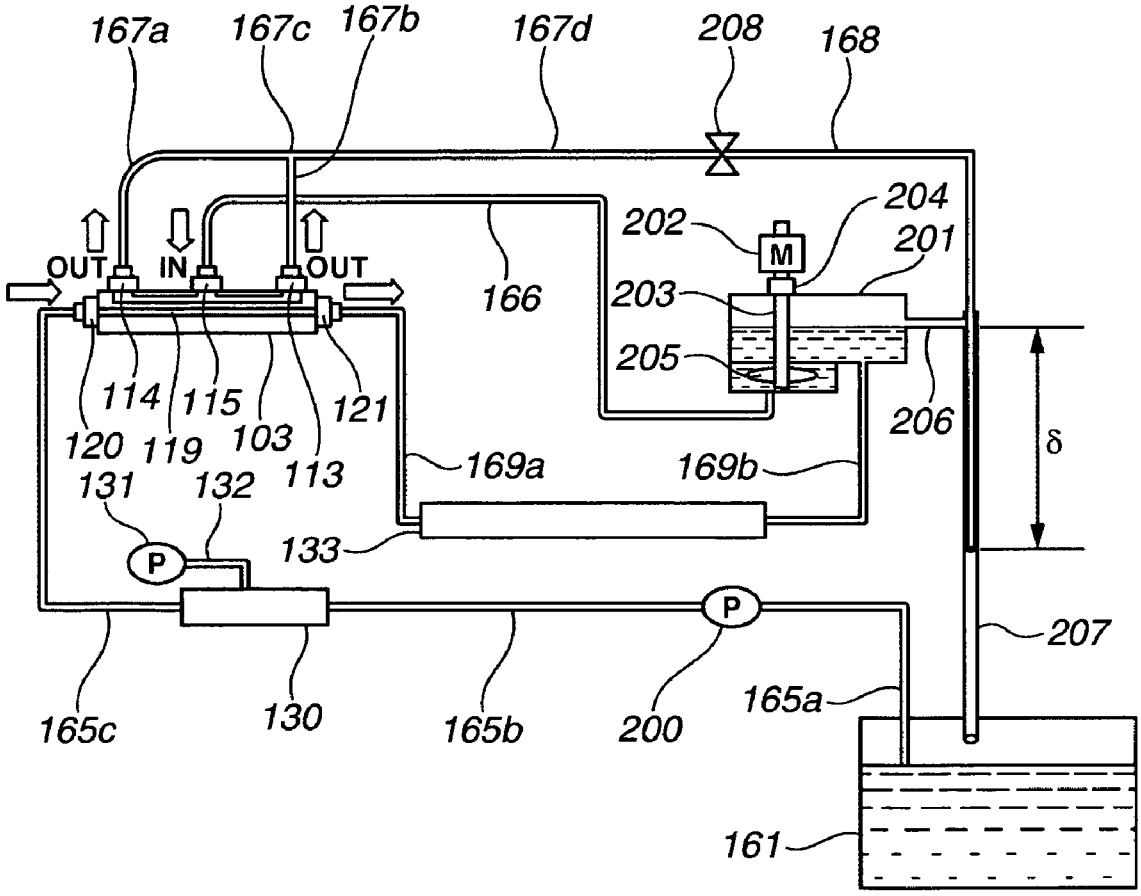
FIG. 1 is a schematic diagram showing an ink supply system of an ink jet recording apparatus according to a first embodiment of the present invention.

The liquid outflow orifices 113 and 114 and the liquid indraft orifice 115 are connected to tubes as shown in FIG. 1, and are configured so as to allow the liquid for printing to flow in and out between the ink supply system and the liquid jet head 103. At both end portions of the head liquid chamber member 112, there are provided fixing holes 108 so as to fix the head liquid chamber member 112 onto the liquid jet recording apparatus main body.

There is no filter provided at a portion from the liquid indraft orifice 115 to the liquid outflow orifices 113 and 114 in the head liquid chamber 109. Accordingly, the printing liquid flowing from the liquid indraft orifice 115 can flow to the liquid outflow orifices 113 and 114 without causing any pressure loss.

The liquid to be consumed by the discharge of the liquid is supplied from the head liquid chamber 109, then passes through the filter member 151 corresponding to each of the element substrates 101, and then is supplied to each of the discharge ports 102 via each of the common liquid chambers 110 and the slit 104.

The in-substrate liquid path 119 provided on the base substrate of the liquid jet head 103 and the liquid indraft orifice and the liquid outflow orifice of the in-substrate liquid path 119 are described next with reference to FIG. 4 and FIG. 5.

In the in-substrate liquid path 119, the liquid for cooling the liquid jet head 103 flows.

The base substrate of the liquid jet head 103 is configured by bonding two members together, namely, the upper base substrate 111 and the lower base substrate 118, as shown in FIG. 4, FIG. 6B, FIG. 6D, or FIG. 7.

At each of the base substrates 111 and 118, there is provided a notch that configures the common liquid chamber 110, correspondingly with the position of the element substrate 101. The lower base substrate 118 is provided with two grooves that constitute the in-substrate liquid path 119 near the common liquid chamber 110 in a manner surrounding the whole common liquid chamber 110. As shown in FIG. 7, by bonding the upper base substrate 111 and the lower base substrate 118 together, the in-substrate liquid path 119 is configured so as not to be communicated with the common liquid chamber 110. At both ends of the two in-substrate liquid paths 119, SUS pipes are disposed, as shown in FIG. 3, FIG. 4, and FIG. 5, and a coolant indraft orifice 120 and a coolant outflow orifice 121 are provided in a manner protruding to the outside of the head liquid chamber member 112.

Here, in FIG. 1, the coolant indraft orifice 120 and the coolant outflow orifice 121 are indicated at one position only, respectively. However, the coolant indraft orifice 120 and the coolant outflow orifice 121 are shown in one position in order merely to make it easier to clearly show the configuration, and the number of coolant indraft orifices 120 and the number of coolant outflow orifices 121 are not limited to one.

In the present embodiment, the coolant indraft orifice 120 and the coolant outflow orifice 121 are provided at two positions, respectively, as shown in FIG. 3 through FIG. 6D. In addition, as shown in FIG. 1, the coolant indraft orifice 120 is connected to a tube 165*c*, and the coolant outflow orifice 121 is connected to a tube 169*a*.

As described above, in the liquid jet head 103, the in-substrate liquid path 119, which is a path for cooling liquid, is provided completely independent of the paths for the ink used for printing, such as the head liquid chamber 109 and the common liquid chamber 110.

Accordingly, the liquid for cooling the liquid jet head 103 can be circulated in the liquid jet head 103 without affecting the discharge operation at the time of printing.

The overall configuration of the ink supply system is described next with reference to FIG. 1, FIG. 8, and FIGS. 9A and 9B.

FIG. 1 is a view showing the ink supply system of the liquid jet recording apparatus according to the first embodiment of the present invention.

A sub-tank drawing pump 200 can draw the liquid from a liquid reserve tank 161 to a sub-tank 201 via tubes 165*a* and 165*b*, a de-aerating device 130, the tube 165*c*, the in-substrate liquid path 119, the tube 169*a*, an ink cooling device 133, and a tube 169*b*.

On the side surface of the sub-tank 201, there is provided a drain 206. When an amount of the liquid drawn from the liquid reserve tank 161 to the sub-tank 201 exceeds a given amount, the liquid flows out of the drain 206.

The liquid that flows out of the drain 206 returns to the liquid reserve tank 161 through a tube 207.

The level of the liquid in the sub-tank 201 may be always retained at a constant level by constantly operating the sub-tank drawing pump 200.

A liquid level detecting sensor may be provided that is capable of detecting that in a case where the liquid level in the sub-tank 201 is lowered by the discharge of the liquid, the liquid level has been lowered by about 10 mm from a liquid level at which the liquid flows from the drain 206.

The sub-tank drawing pump 200 may be operated for only a given period of time when it is detected by the liquid level detecting sensor that the liquid level has been lowered.

In the present embodiment, the sub-tank drawing pump 200 is continuously operated while the liquid jet head 103 is carrying out the discharge operation.

At this time, a liquid flow by the sub-tank drawing pump 200 is about 200 ml/min. The sub-tank drawing pump 200 includes a tube pump.

The tube pump is a pump that feeds the liquid in the tube by squeezing the tube from the outside of the tube with a roller. The tube pump, in general, generates a great pulsation.

Vertical positions of the liquid jet head 103 and the drain 206 provided at the sub-tank 201 are determined so that the liquid level at which the liquid in the sub-tank 201 flows out of the drain 206 is lower than the level of the discharge ports 102 of the liquid jet head 103 by about 25 mm.

The configuration of the de-aerating device 130 disposed between the liquid reserve tank 161 and the liquid jet head 103 is described next with reference to an enlarged view 214 shown in FIG. 8 that illustrates an inside portion of the de-aerating device 130.

In the de-aerating device 130, a hollow fiber-like gas permeable filter 217 is provided in a bundle shape, and ink 212 flows through the gas permeable filter 217.

The periphery of the hollow fiber-like gas permeable filter 217 is evacuated by suction by a vacuum pump 131 via a vacuum tube 132.

A dissolved gas 216 is removed from the ink 212, which flows through the hollow fiber, via the gas permeable filter 217.

Figure 8:
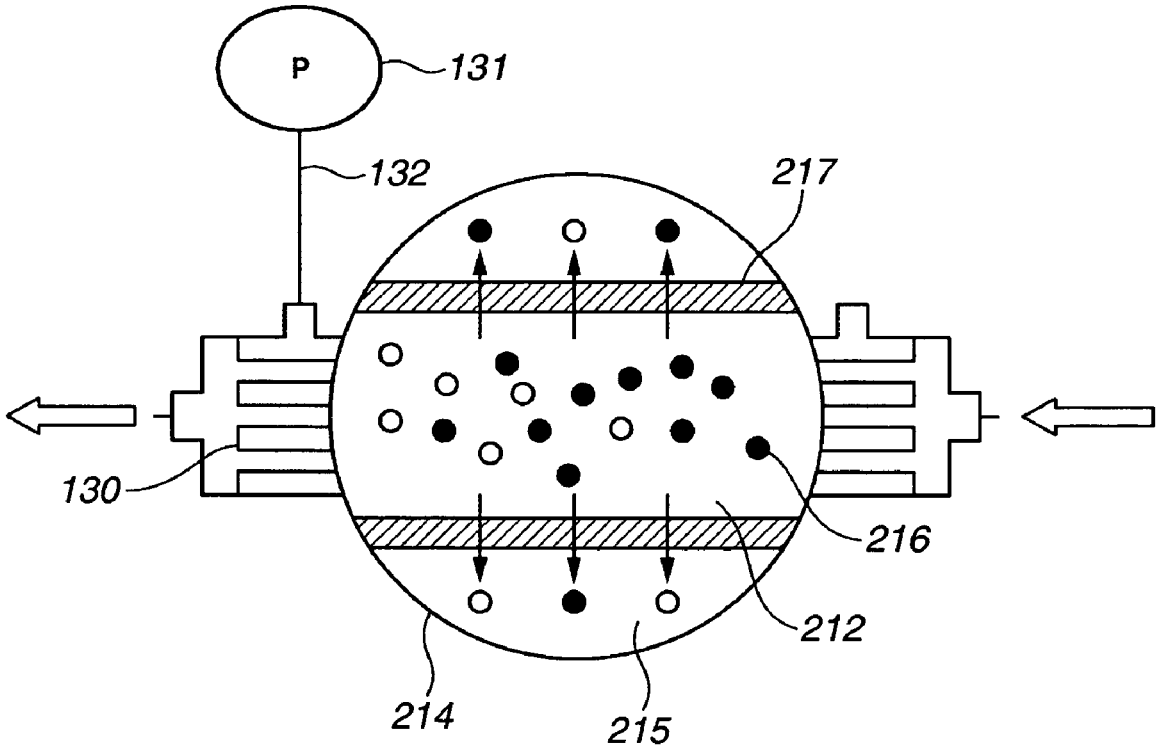
FIG. 8 is a view explaining a de-aerating device according to the first embodiment of the present invention.

The de-aerating device 130 as used in the present embodiment is a de-aerating device shown in FIG. 8 that is disclosed in, for example, Japanese Patent Application Laid-Open No. 05-17712, and is a common unspecialized device.

The ink drawn from the liquid reserve tank 161 by the sub-tank drawing pump 200 passes through the de-aerating device 130 and then flows into the tube 165*c* in a de-aerated state.

Here, all of the tubes that feed the de-aerated liquid at the downstream side of the de-aerating device 130 have a low gas permeability. In addition, for all such tubes, a PVDF (polyvinylidene fluoride) tube that is highly ink-resistant is used.

Accordingly, a sufficient level of de-aeration of the liquid can be maintained even after the liquid passes through the de-aerating device 130.

A head cooling system is described next. The liquid that passes through the in-substrate liquid path 119 during the printing operation flows from the coolant outflow orifice 121 into the liquid cooling device 133 via the tube 169*a* in a state in which the temperature of the liquid is raised by robbing heat generated by the discharge operation of the liquid jet head 103.

Figure 9A:
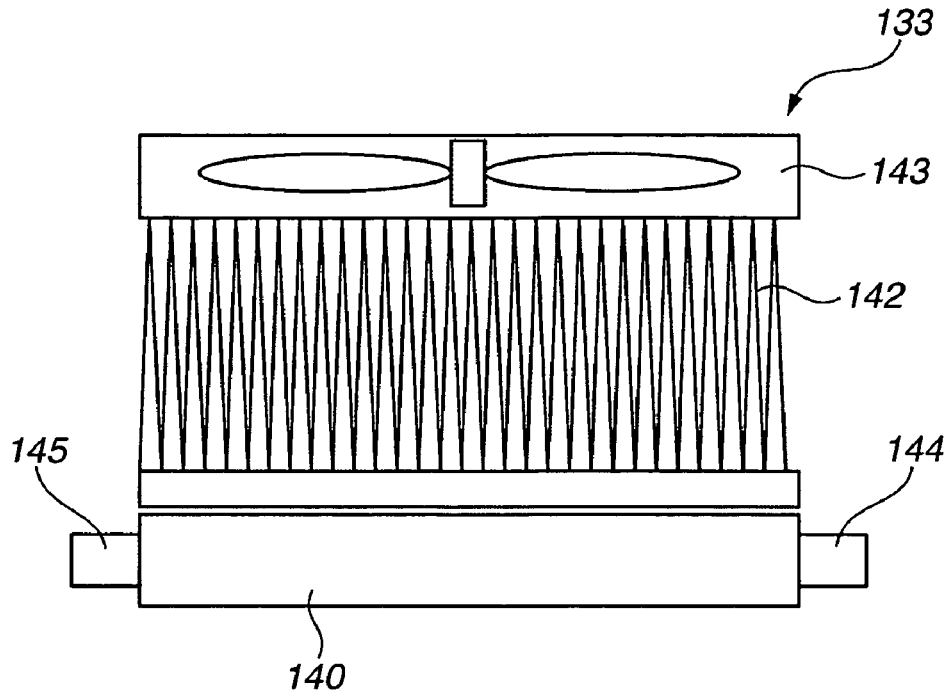
FIG. 9A is a view showing a configuration of a liquid cooling device according to the first embodiment of the present invention.
Figure 9B:
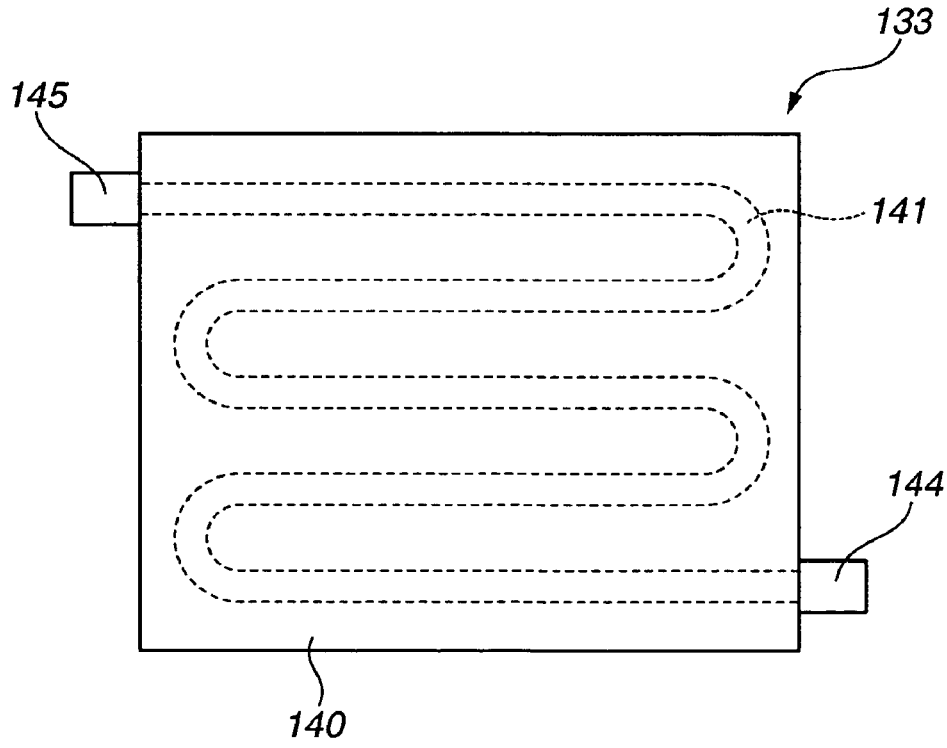
FIG. 9B is a view showing a liquid flow path of the liquid cooling device according to the first embodiment of the present invention.

The liquid cooling device 133 has a configuration as shown in FIG. 9A and FIG. 9B.

That is, the liquid cooling device 133 has the configuration such that the liquid that flows into the liquid cooling device 133 from a liquid indraft orifice 144 passes through a cooling flow path 141 formed in a cooling plate 140 made of a stainless plate having high ink-resistance, and then flows out of a liquid outflow orifice 145.

As shown in FIG. 9A, a fin 142 is attached firmly to the cooling plate 140, and a fan 143 is disposed above the fin 142.

The fan 143 is operated while the discharge operation is carried out by the liquid jet head 103 and the sub-tank drawing pump 200 is operated.

When the liquid whose temperature has been raised by the passage through the liquid jet head 103 passes through the liquid cooling device 133, the temperature of the liquid is lowered. FIG. 9B is a view illustrating a liquid flow path of the liquid cooling device 133.

The liquid that flows through the in-substrate liquid path 119, which cools the liquid jet head 103 and is disposed in the liquid jet head 103, and the liquid that flows through the cooling flow path 141, which is disposed in the liquid cooling device 133, are liquids de-aerated by the de-aerating device 130.

Inside of the in-substrate liquid path 119 and inside of the cooling flow path 141 are free from air due to the passage of the de-aerated liquid.

In a case where air exists in either one of the two paths, namely the in-substrate liquid path 119 and the cooling flow path 141, the air plays a role of a heat insulating barrier. In this case, it is not possible to effectively transfer heat.

In the present embodiment, the de-aerated liquid is made to flow, and consequently, air disappears by being dissolved into the liquid with time, even when the air exists in the liquid path.

Accordingly, more effective heat exchange is conducted in the in-substrate liquid path 119 and the cooling flow path 141. Consequently, it is possible to more effectively reduce the rising of temperature of the liquid jet head 103. In other words, it is possible to lower the temperature of the liquid that has passed through the liquid cooling device 133.

The sub-tank 201 is described next.

To the sub-tank 201, there are attached a pressure motor 202 and a fan wheel 205. The fan wheel 205 is mounted on the edge portion of a shaft 203 of the pressure motor 202 on the side opposite to the pressure motor 202. The shaft 203 is supported by a bearing 204.

In the present embodiment, ink for printing flows into the liquid jet head 103 via the sub-tank 201.

In addition, in the present embodiment, ink is not supplied directly from any ink cartridge into the liquid jet head 103.

According to the present embodiment, it is possible to obtain excellent images even when it is necessary to supply a large amount of ink in the case of high speed printing with a full line head because the meniscus fluctuation, caused by a change in a head difference due to fluctuations in the liquid level of ink in a main tank, is not likely to occur in an ink discharge section.

The pressure motor 202 can be a DC motor.

The pressure motor 202 is rotated responsive to a voltage applied thereto. An amount of rotational drive of the pressure motor 202 is transferred to the fan wheel 205 via the shaft 203. The pressure motor 202 constitutes a pressure pump to generate the pressure for feeding the liquid in the sub-tank 201 to a tube 166.

In addition, even when the pressure motor 202 is in a suspended state, it is possible to allow the liquid to flow inside the pressure pump because there exists a clearance large enough to allow the liquid to flow between fans of the fan wheel 205 since the pressure pump is a centrifugal spiral pump configured by the fan wheel 205.

The pressure pump in the present embodiment has a configuration such that the liquid is fed under pressure by a high speed rotation of the fan wheel 205.

Accordingly, the pressure pump in the present embodiment has a characteristic such that there occurs almost no pulsating flow at the time of pressure-feeding of the liquid, as compared to a diaphragm pump configured by a combination of a diaphragm and a check valve and capable of allowing the liquid to flow in an amount as much as the pressure pump of the present embodiment, or as compared to a tube pump that feeds the liquid under pressure by squeezing a tube with a roller.

The tube 166, one end of which is connected to the sub-tank 201, is connected, at its other end, to the printing liquid indraft orifice 115, which is provided in a substantially center portion of the liquid jet head 103, to supply the liquid to the liquid jet head 103.

On the other hand, to the liquid outflow orifices 113 and 114, which are provided at the positions near both ends of the liquid jet head 103, there are connected a tube 167*a* and a tube 167*b*, respectively.

A confluence 167*c* of the tube 167*a* and the tube 167*b* is connected to a tube 168 via a tube 167*d* and a two-way valve 208, which is configured by a solenoid valve.

An end of the tube 168 opposite to the side of the two-way valve 208 is connected to the tube 207, in which the liquid overflowing from the sub-tank 201 flows when returning to the liquid reserve tank 161.

The front end of the tube 168 is inserted into the tube 207 to reach a position that is lower than the liquid level of the sub-tank 201 by a distance 6. Here, the two-way valve 208 is a two-way type valve configured by a solenoid valve that is opened when a voltage is applied and is closed when no voltage is applied.

Since the front end of the tube 168 is located at the position lower than the liquid level of the sub-tank 201 by the distance δ, when the two-way valve 208 is opened by a voltage applied thereto, the liquid in the sub-tank 201 passes through the liquid jet head 103 and is circulated due to a head difference between the liquid jet head 103 and the sub-tank 201.

The vertical position of the drain 206 is determined so that the liquid level of the sub-tank 201 is lower than the vertical position of the discharge ports 102 of the liquid jet head 103 by about 25 mm.

However, because the front end of the tube 168 is disposed so as to be at a vertical position much lower than the liquid level of the sub-tank 201, the liquid jet head 103 is subjected to a large negative pressure.

In order to prevent this, a small amount of voltage is applied to the pressure motor 202 to slowly rotate the fan wheel 205. Accordingly, the liquid jet head 103 is pressurized with a small amount of pressure so as to adjust the level of the pressure applied to the liquid jet head 103 to an appropriate level.

A rotational frequency of the pressure motor 202 is determined so that the pressure inside the head liquid chamber 109 of the liquid jet head 103 is about −25 mm $H_2O$ to −50 mm $H_2O$ with respect to atmospheric pressure.

At this time, when the operation of the pressure motor 202 is started, an amount of the circulated liquid is increased to a certain extent compared to the amount of the circulated liquid at the time when the pressure motor 202 is not operated.

However, because there is no such cause as a filter, for example, for bringing about a large pressure loss in the liquid circulation paths, the pressure in the head liquid chamber 109 is retained at an appropriate level by the head difference and the operation of the pressure motor 202.

Consequently, there occurs no leakage of the ink from the discharge ports 102 due to the circulation of the liquid. On the other hand, the discharge ports 102 do not draw in air due to the circulation of the liquid.

A value of the distance δ at this time is about 250 mm. In addition, a flow rate of the liquid circulated through the liquid jet head 103 is about 15 ml/min.

In addition, when the two-way valve 208 is closed and no voltage is applied to the pressure motor 202, a negative pressure is applied to the liquid jet head 103 in an amount generated due to a difference of the liquid level of the sub-tank 201 that is 25 mm lower than the level of the discharge ports 102 of the liquid jet head 103.

Consequently, there occurs no leakage of the ink from the discharge ports 102 even when the two-way valve 208 is closed. On the other hand, the discharge ports 102 do not draw in air even when the two-way valve 208 is closed.

In addition, when the liquid jet head 103 does not carry out the discharge operation and if it is not necessary to circulate the liquid in the head 103, the circulation of the liquid is stopped by closing the two-way valve 208.

When it is desired to start the circulation of the liquid, the operation for opening the two-way valve 208 and the operation for rotating the pressure motor 202 are carried out at the same time.

The operation for discharging the liquid carried out by the ink supply system of the liquid jet recording apparatus configured as described above is now described next.

When the liquid jet recording apparatus according to the present embodiment is turned on, the sub-tank drawing pump 200 and the pressure motor 202 start to rotate at the same time, and in addition, a voltage is applied to the two-way valve 208 to open the flow path.

In addition, the operation of the vacuum pump 131 is started at the same time, and the de-aeration of the liquid passing through the de-aerating device 130 is carried out.

The liquid from the liquid reserve tank 161 flows into the coolant indraft orifice 120 via the tube 165*a*, the sub-tank drawing pump 200, the tube 165*b*, the de-aerating device 130, and the tube 165*c*.

Further, the liquid passes through the in-substrate liquid path 119, the coolant outflow orifice 121, the tube 169*a*, the liquid cooling device 133, and the tube 169*b*, and then flows into the sub-tank 201.

At this time, the liquid jet recording apparatus is merely turned on. That is, the liquid jet recording apparatus does not yet receive a signal indicating the start of printing, and consequently, does not yet carry out the discharge operation. Thus, the temperature of the liquid jet head 103 is not yet raised at this time.

Therefore, the fan 143 mounted in the liquid cooling device 133 is not yet operated at this time.

The liquid that flows into the sub-tank 201 flows by the slow rotation of the pressure motor 202, as well as by the head difference corresponding to the distance δ between the liquid level of the sub-tank 201 and the level of the front end of the tube 168.

Some of the liquid flows from the sub-tank 201 and is circulated through the tube 166, the head liquid chamber 109 of the liquid jet head 103, the tube 167*a*, the tube 167*b*, the confluence 167*c*, the tube 167*d*, and the tube 168, and then is returned to the liquid reserve tank 161.

However, most of the liquid overflows from the drain 206 mounted on the side surface of the sub-tank 201. The overflowed liquid passes through the tube 207 and is returned to the liquid reserve tank 161.

At this time, the head difference 6 and the voltage applied to the pressure motor 202 are adjusted so that the flow rate of the liquid circulating through the head liquid chamber 109 is about 15 ml/min.

The flow rate of the liquid circulating through the in-substrate liquid path 119 is set to be 200 ml/min by the sub-tank drawing pump 200.

Accordingly, the flow rate of the liquid overflowing out of the sub-tank 201 to the drain 206 is about 185 ml/min.

At this time, since the operation of the vacuum pump 131 is started, the inside of the sub-tank 201 is filled with the de-aerated liquid, and thus, the inside of the head liquid chamber 109 of the liquid jet head 103 is also filled with the de-aerated liquid.

In addition to this, because the de-aerated liquid is circulated through all of the liquid paths on the downstream side of the de-aerating device 130, even if there exists air in the liquid paths on the downstream side of the de-aerating device 130, air is dissolved into the de-aerated liquid.

Accordingly, the liquid supply paths are almost entirely filled with the liquid only, and there exists no air.

As described above, the head difference 6 and the voltage applied to the pressure motor 202 are determined so that the pressure inside the head liquid chamber 109 of the liquid jet head 103 is about −25 mm $H_2O$ to −50 mm $H_2O$ with respect to atmospheric pressure.

In addition, because the liquid is circulated due to the rotation of the fan wheel 205 and the head difference 6, there occurs no pulsation of the liquid.

Further, there is no such cause as a filter for bringing about a large pressure loss in the liquid circulation paths.

Accordingly, the level of the pressure inside the head liquid chamber 109 is maintained to be at an appropriate level, and, thus, there occurs no leakage of the ink from the discharge ports 102 due to the circulation of the liquid. On the other hand, the discharge ports 102 do not draw in air due to the circulation of the liquid.

When a signal for printing is transmitted to the liquid jet recording apparatus, the operation of the fan 143 mounted in the liquid cooling device 133 is started. At this time, the operation of each pump and valve is not stopped.

When image data for printing is transmitted to the liquid jet head 103, a voltage is applied to the heating element provided inside the element substrate 101, and the liquid that is brought into contact with the heating element is discharged from the discharge ports 102 by film boiling pressure.

At this time, the liquid in a discharged amount is circulated from the sub-tank 201 to the liquid jet head 103.

The liquid currently passing through the head liquid chamber 109 passes through the filter member 151 corresponding to each of the element substrates 101, then passes through the common liquid chamber 110 and the slit 104, and is then supplied to the discharge ports 102.

When image data requiring continuous discharge of the liquid from all of the discharge ports 102 in one element substrate 101 is transmitted, the amount of liquid that passes through the filter member 151 becomes maximum.

In the present embodiment, the size of one droplet discharged from each of the discharge ports 102 is about 4 pl.

Here, the discharge ports 102 are arranged at a resolution of 1,200 dpi, and an effective printing width with respect to one element substrate 101 is about one inch. Accordingly, the total number of discharge ports 102 in one element substrate 101 is 1,200.

In this case, since the liquid jet recording apparatus is operated so that a frequency for discharging droplets at each of the discharge ports 102 is 16 kHz, a maximum droplet discharge amount by one element substrate 101 is 5.184 ml/min. Here, an effective area of the filter member 151 corresponding to each of the element substrates 101 is expressed as 3.5 mm (width)×30 mm (length)=105 $mm^2$.

In the filter member 151 as used in the present embodiment, the pressure loss obtained by an experiment in a case where the flow rate is 5.184 ml/min is approximately 12.5 mm $H_2O$ (0.123 kPa).

This level of the pressure loss causes almost no problem because the pressure loss is small enough with respect to 200 mm $H_2O$ (1.96 kPa), which is a level at which the discharge of droplets is adversely affected.

This applies to all of the element substrates 101 provided in the liquid jet head 103.

In addition, if droplets are discharged from all of the discharge ports 102 of all of the element substrates 101 in the liquid jet head 103, a total liquid discharge amount is eight times as much as the maximum liquid discharge amount in the case where the discharge is carried out by one element substrate 101. That is, in this case, the total liquid discharge amount is 41.472 ml/min.

When the printing operation is actually carried out, there are intervals between each recording medium. Accordingly, the discharge operation is suspended during the intervals.

Here, an average amount of discharged liquid including an amount of liquid discharged while the discharge operation is suspended is about 60% of the total liquid discharge amount, namely, about 25 ml/min.

The flow rate of the circulated liquid while the printing operation is not carried out is 15 ml/min. The average flow rate of the liquid used for discharge is 25 ml/min. In order to compensate for the difference between the flow rate of the circulated liquid while the printing operation is not carried out and the average flow rate of the liquid used for discharge, an amount equivalent to a half of the average flow rate of the liquid used for discharge (namely, 12.5 ml/min) is supplied from the tube 169*b* to the sub-tank 201.

Consequently, an average flow rate of the liquid that flows from the sub-tank 201 to the liquid jet head 103 is 27.5 ml/min, and on the other hand, an average flow rate of the liquid that flows to the tube 168 in this case is 2.5 ml/min.

Therefore, because the average flow rate does not fall short of the average flow rate of the liquid used for discharge, the liquid on the side of the tube 168 is not completely consumed by the discharge operation.

When the discharge operation is ended, the liquid is circulated through the head liquid chamber 109 at a flow rate of 15 ml/min again.

On the other hand, the sub-tank drawing pump 200 carries out the drawing operation at a flow rate of 200 ml/min even while the discharge operation is carried out.

The flow rate of 200 ml/min is a value sufficiently greater than the maximum average flow rate of 27.5 ml/min at the time of discharge of the liquid flowing from the sub-tank 201. Consequently, the liquid level in the sub-tank 201 is not lowered.

In addition, the liquid that is to be supplied to the sub-tank 201 passes through the in-substrate liquid path 119 and robs heat generated by the discharge operation. After that, the liquid is cooled by the liquid cooling device 133, and is then supplied to the sub-tank 201.

Accordingly, the temperature of the liquid in the sub-tank 201 is not so much different from the temperature of the liquid in the liquid reserve tank 161.

However, the temperature of the liquid returning from the tube 168 to the liquid reserve tank 161 after passing through the head liquid chamber 109 and robbing heat generated by the discharge operation is raised.

In this regard, however, during the printing operation, the flow rate of the liquid in the liquid reserve tank 161, namely the flow rate of the liquid that passes through the liquid cooling device 133 and returns from the sub-tank 201, is 172.5 ml/min at a minimum.

On the other hand, the flow rate of the liquid returning from the tube 168 to the liquid reserve tank 161 is 15 ml/min at a maximum. In other words, the maximum flow rate in this case is more than ten times greater than the minimum flow rate, and consequently, the temperature of the liquid in the liquid reserve tank 161 is not so much raised.

Thus, when the printing operation is carried out, the liquid is always circulated through the head liquid chamber 109, as well as in the in-substrate liquid path 119.

In this way, it is possible to prevent the rising of the temperature of the liquid jet head 103 even in a case where the discharge operation is carried out with a large number of discharge ports 102.

In addition, at the time immediately after the liquid jet head 103 is connected to the ink supply system or in a case where the discharge operation has not been carried out for a certain period of time, a pressurized recovery operation is carried out by the pressure motor 202 before the printing operation is started.

In this case, the pressure motor 202 is rotated at a rotational frequency much higher than the rotational frequency at the time of the discharge operation, and the liquid is pressurized until the pressure in the head liquid chamber 109 is brought to be about 0.04 MPa or higher.

At this time, the two-way valve 208 is closed and the liquid does not flow.

The pressurized liquid is discharged from the discharge ports 102 together with air remaining in the liquid jet head 103, and consequently, the inside of the liquid jet head 103 is wholly filled with the liquid.

In this case, even if the liquid in the sub-tank 201 is consumed due to the discharge operation, the sub-tank drawing pump 200 is continuously operated so as to supply the liquid from the liquid reserve tank 161 to the sub-tank 201 in an amount more than the amount of the liquid consumed by the discharge operation.

Accordingly, the liquid level in the sub-tank 201 is always maintained to be at a constant level.

In addition, the liquid that passes through the de-aerating device 130 and the liquid cooling device 133 is continuously supplied to the sub-tank 201. Thus, the de-aerated and cooled ink is supplied to the liquid jet head 103.

In this regard, it is generally known that a steady discharge operation is secured in a case where the de-aerated ink is supplied to the head.

In the present embodiment, the de-aerated and cooled ink is supplied in a manner such that the de-aerated and cooled ink is continuously and always circulated through the head liquid chamber 109 of the liquid jet head 103 when the liquid jet head 103 carries out the discharge operation.

Here, there is another advantage of supplying the de-aerated and cooled ink to the liquid jet head 103, in addition to the discharge stabilization effect.

That is, it is possible to reduce the temperature rise in the liquid jet head 103 even when the liquid jet head 103 continuously carries out the discharge operation. This is made possible by the combination of effects obtained by the continuous circulation of the ink in the in-substrate liquid path 119 in the base substrates 111 and 118 and the continuous circulation of the ink in the head liquid chamber 109.

Thus, a liquid jet recording apparatus capable of implementing a highly stabilized discharge operation can be provided in which there occurs no increase in the discharge amount occurring due to the rise in the temperature.

In addition, by implementing the circulation of the ink in the head liquid chamber 109 by using the head difference and the slow rotation of the pressure motor 202, the ink can be supplied without pulsation. Thus, because the number of movable portions is small, a liquid jet recording apparatus with high durability and high reliability can be provided.

Second Embodiment

A liquid jet recording apparatus according to a second embodiment of the present invention is described below with reference to FIG. 10, FIG. 11A, and FIG. 11B.

Figure 10:
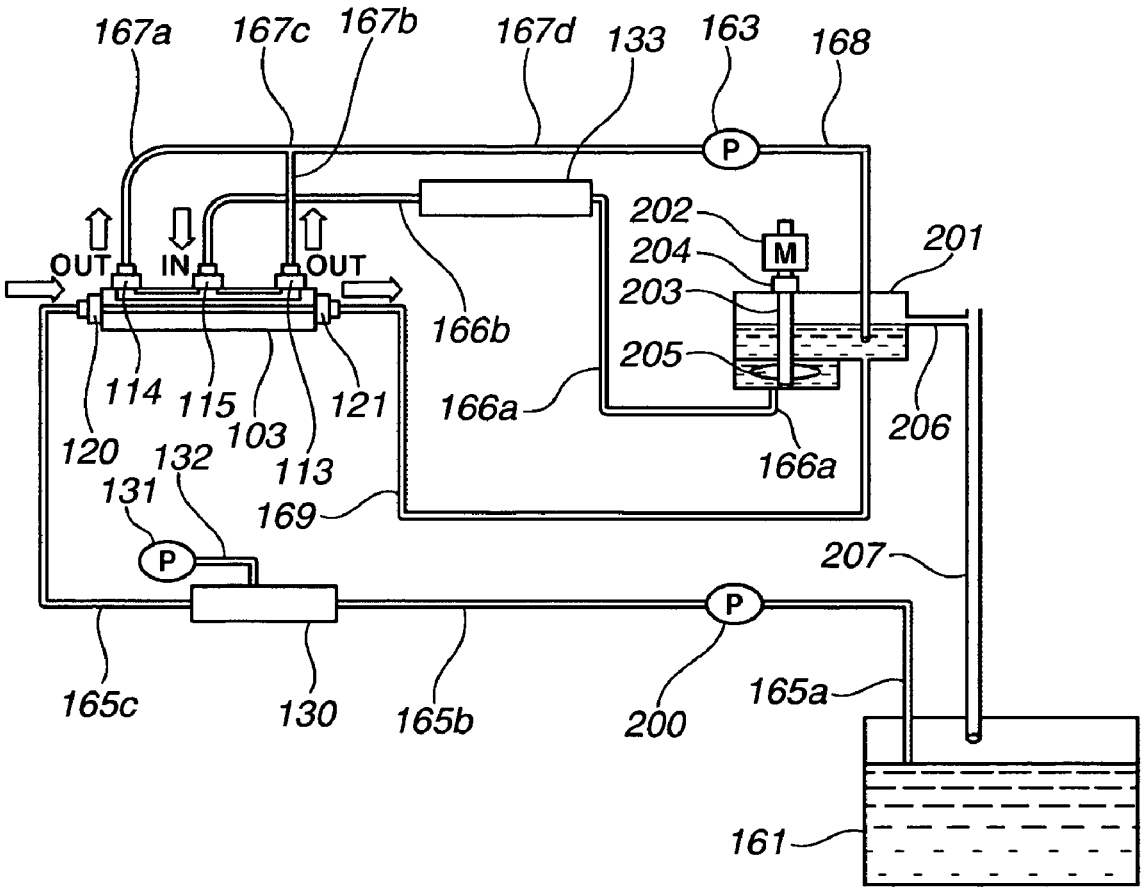
FIG. 10 is a schematic diagram showing an ink supply system of an ink jet recording apparatus according to a second embodiment of the present invention.
Figure 11A:
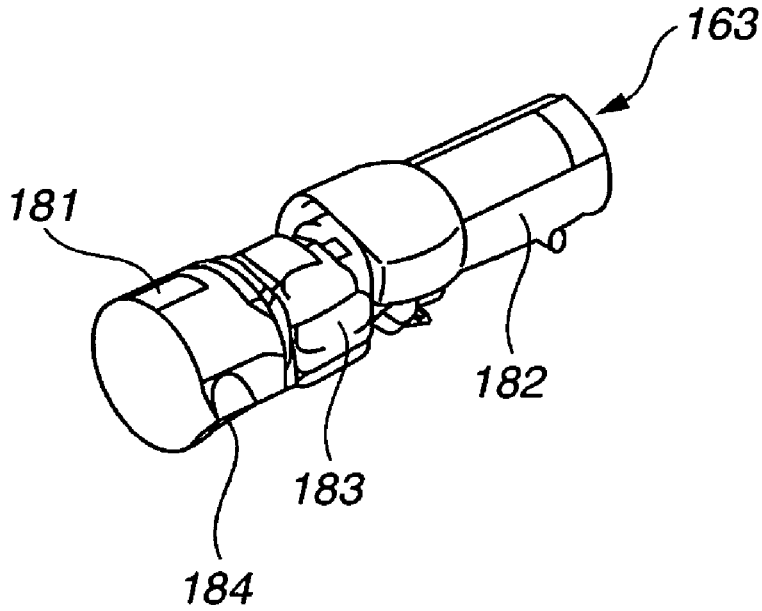
FIG. 11A is a perspective view showing a liquid suction pump according to the second embodiment of the present invention.

FIG. 10 is a view showing the configuration of an ink supply system of the liquid jet recording apparatus according to the second embodiment of the present invention. FIG. 11A and FIG. 11B are views showing the configuration of a gear pump used as a liquid suction pump 163 in the second embodiment. The configuration of the ink supply system is mostly similar to the configuration as described in the first embodiment. However, some portion of the configuration is different from the configuration as described in the first embodiment. Therefore, an explanation as to the portion that is the same as the configuration in the first embodiment is not repeated here, and the explanation is made only as to the portion that is different from the configuration in the first embodiment.

In the configuration of the ink supply system shown in FIG. 10, a point in difference from the first embodiment is that the liquid cooling device 133 is provided in the middle of a path connecting the sub-tank 201 to the liquid jet head 103.

Further, there is provided a liquid suction pump 163 between the tube 167*d* and the tube 168, instead of the two-way valve 208 as described in the first embodiment.

In addition, there is still another point in difference from the first embodiment. That is, one end of the tube 168 is guided to the sub-tank 201. The other portions are similar to those in the first embodiment.

The configuration of the liquid suction pump 163 is described next with reference to FIG. 11A and FIG. 11B.

The liquid suction pump 163 is a gear pump that feeds the liquid under pressure by the rotation of two gears engaged with each other. FIG. 11A is an external view of the liquid suction pump 163, and FIG. 11B is a view explaining an operational principle of the liquid suction pump 163.

The liquid suction pump 163 includes a DC motor 182 configured to drive a driving gear 186 and a driven gear 187, which are provided in a pump head 181. The DC motor 182 transmits a driving force to the driving gear 186 via a magnet rotation transmission section 183.

Figure 11B:
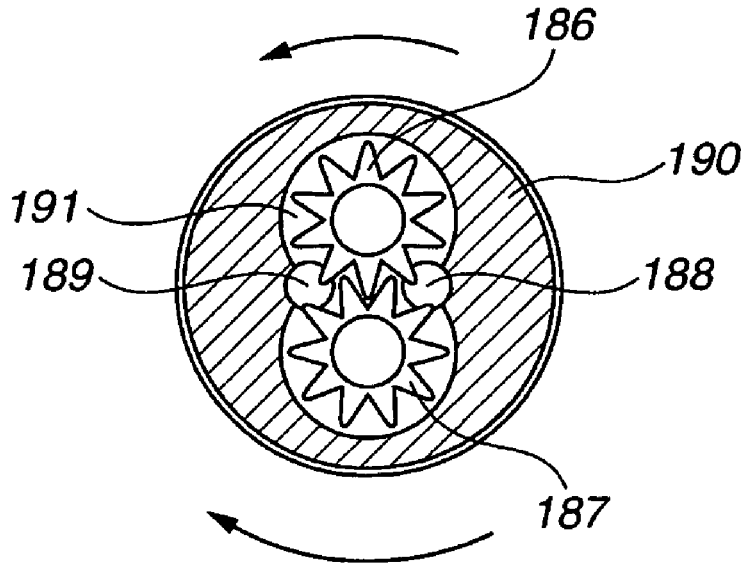
FIG. 11B is a cross sectional view explaining gears of the liquid suction pump according to the second embodiment of the present invention.

In the pump head 181, as shown in FIG. 11B, the driving gear 186 and the driven gear 187 are disposed in a mutually engaged manner in a casing 190.

In addition, the pump head 181 includes a pump liquid chamber 191 formed in a shape leaving almost no gap with a circle substantially equal to the tip circle of the gears 186 and 187, except for the portions of a liquid indraft orifice 188 and a liquid outflow orifice 189 provided to the right and the left of the engaging portions of the gears 186 and 187, respectively.

The liquid indraft orifice 188 is communicated with a liquid indraft orifice 184 provided on the side surface of the pump head 181. On the other hand, the liquid outflow orifice 189 is communicated with a liquid outflow orifice (not shown) that is opened at the side opposite to the side of the liquid indraft orifice 184 of the pump head 181.

When current is supplied to the DC motor 182 and a rotation driving force is transmitted to the driving gear 186 via the magnet rotation transmission section 183, the driving gear 186 starts to rotate in cooperation with the driven gear 187 in the respective directions indicated by arrows shown in FIG. 11B.

Because there is almost no clearance between the tips of each of the gears 186 and 187 and an inner wall of the pump liquid chamber 191 in the casing 190, the liquid that flows in between the teeth of each of the gears 186 and 187 is retained in the portion between the tips of each of the gears 186 and 187 and the inner wall of the pump liquid chamber 191 and is fed in the directions of the arrows shown in FIG. 11B.

At an engaging portion of the gears 186 and 187, there is present the tooth that is engaged between the teeth of the other gear. Consequently, the liquid is fed in a small amount only. Thus, the amount of the liquid that is fed between the inner wall of the pump liquid chamber 191 and the gears 186 and 187 is much larger than the amount of the liquid fed at the engaging portion of the gears 186 and 187.

As a result, in the pump liquid chamber 191, a negative pressure is generated on the side of the liquid indraft orifice 188 and a positive pressure is generated on the side of the liquid outflow orifice 189, so that the liquid is fed under pressure.

The liquid suction pump 163 has a characteristic such that a constant volume of liquid held in the portion between the casing 190 and each of the gears 186 and 187 is fed.

That is, if the difference in the pressure across the liquid suction pump 163 is at a certain constant value and if the rotational frequency of the gears 186 and 187 is maintained to be constant, the liquid can flow in a substantially constant amount regardless of the pressure difference across the liquid suction pump 163.

In addition, the space formed between the teeth of the gears 186 and 187 and the casing 190 is a very small space.

Therefore, just as in the case of the pressure pump constituted by the pressure motor 202 and the fan wheel 205, the level of the pulsation of the liquid at the time of feeding is vanishingly low as compared to a diaphragm pump or a tube pump having a flow rate of the same level.

When the liquid jet recording apparatus is turned on, the operations of the sub-tank drawing pump 200, the pressure motor 202, and the liquid suction pump 163 are started at the same time, just as described in the first embodiment.

In addition, the operation of the vacuum pump 131 is started at the same time and the de-aeration of the liquid passing through the de-aerating device 130 is carried out.

The liquid is drawn from the liquid reserve tank 161, then passes through the tube 165*a*, the sub-tank drawing pump 200, the tube 165*b*, the de-aerating device 130, the tube 165*c*, and the coolant indraft orifice 120, and then flows into the liquid jet head 103.

Further, the liquid passes through the in-substrate liquid path 119, the coolant outflow orifice 121, and the tube 169, and then flows into the sub-tank 201.

Some portion of the liquid that flows into the sub-tank 201 passes through a tube 166*a*, the liquid cooling device 133, and a tube 166*b*, by the operation of the liquid suction pump 163 and the slow rotation of the pressure motor 202.

Further, the liquid is circulated through the head liquid chamber 109 of the liquid jet head 103, the tube 167, and the tube 168, and then is returned to the sub-tank 201. However, most portion of the liquid overflows out of the drain 206 mounted on the side surface of the sub-tank 201.

As a result, the liquid is returned to the liquid reserve tank 161 through the tube 207.

At this time, the liquid jet recording apparatus is merely turned on. That is, the liquid jet recording apparatus does not yet receive a signal indicating the start of printing, and consequently, does not yet carry out the discharge operation.

Here, the temperature of the liquid jet head 103 is not yet raised at this time. Therefore, the fan 143 mounted in the liquid cooling device 133 is not yet operated.

In this case, a voltage is applied to the DC motor 182 of the liquid suction pump 163 so that the flow rate in the liquid suction pump 163 is brought to be 15 ml/min.

If the liquid feeding operation is carried out only by the liquid suction pump 163, a large negative pressure is applied to the liquid jet head 103, just as in the case of the first embodiment.

This is caused by a suction force of the liquid suction pump 163 and a pipe resistance in the ink supply paths leading from the liquid reserve tank 161 to the liquid indraft orifice 115.

If the negative pressure applied to the liquid jet head 103 becomes too large, an ink meniscus formed on the discharge ports 102 is destroyed in a manner as being drawn into the liquid jet head 103 by the negative pressure in the liquid jet head 103.

In addition, air is drawn in from the discharge ports 102, and as a result, the liquid jet head 103 becomes disabled from carrying out the discharge operation.

In order to prevent the negative pressure in the liquid jet head 103 from becoming too large in this way, the operation of the pressure motor 202 is started at the same time as the operation of the liquid suction pump 163 is started.

In this regard, conditions for rotating the pressure motor 202 are determined so that the negative pressure in the liquid jet head 103 is maintained to be at an appropriate level.

The rotational frequency of the pressure motor 202 is determined so that the pressure inside the head liquid chamber 109 of the liquid jet head 103 is about −25 mm $H_2O$ to −50 mm $H_2O$ with respect to atmospheric pressure.

At this time, when the operation of the pressure motor 202 is started, the flow rate of the liquid is determined by the rotational frequency of the liquid suction pump 163, and the liquid is circulated at a flow rate of 15 ml/min in the liquid circulation paths.

In this case, there is no such cause as a filter for bringing about a large pressure loss in the liquid circulation paths.

Consequently, there occurs no leakage of the ink from the discharge ports 102 due to the circulation of the liquid because the pressure in the head liquid chamber 109 is maintained to be at an appropriate level by the liquid suction pump 163 and the operation of the pressure motor 202. On the other hand, the discharge ports 102 do not draw in air due to the circulation of the liquid.

In addition, the flow rate of the liquid circulating through the in-substrate liquid path 119 is set to be 200 ml/min by the sub-tank drawing pump 200.

Accordingly, the flow rate of the liquid overflowing out of the sub-tank 201 to the drain 206 is 185 ml/min.

Here, since the vacuum pump 131 is started to operate, the inside of the sub-tank 201 is filled with the de-aerated liquid, and, thereby, the inside of the head liquid chamber 109 of the liquid jet head 103 is also filled with the de-aerated liquid.

In addition to this, the de-aerated liquid is circulated through all of the liquid paths on the downstream side of the de-aerating device 130.

If there exists air in the liquid paths on the downstream side of the de-aerating device 130, the air is dissolved into the de-aerated liquid. Therefore, the whole portion of the liquid path is filled with the liquid only, and thus there exists no air.

In addition, as described above, voltages to be applied to the liquid suction pump 163 and the pressure motor 202 are determined so that the pressure inside the head liquid chamber 109 of the liquid jet head 103 is about −25 mm $H_2O$ to −50 mm $H_2O$ with respect to atmospheric pressure.

In addition, the liquid is circulated by the rotation of the fan wheel 205 and the liquid suction pump 163, so that there occurs no pulsation with respect to the liquid flow.

Further, there is no such cause as a filter for bringing about a large pressure loss in the liquid circulation paths.

Accordingly, since the level of the pressure inside the head liquid chamber 109 is maintained to be at an appropriate level, there occurs no leakage of the ink from the discharge ports 102 due to the circulation of the liquid. On the other hand, the discharge ports 102 do not draw in air due to the circulation of the liquid.

In addition, just as in the case of the first embodiment, at the time immediately after the liquid jet head 103 is connected to the ink supply system or in a case where the discharge operation has not been carried out for a certain period of time, a pressurized recovery operation is carried out by the pressure motor 202 before the printing operation is started.

In this case, the pressure motor 202 is rotated at a rotational frequency much higher than the rotational frequency at the time of the discharge operation, and the liquid is pressurized until the pressure in the head liquid chamber 109 is brought to be about 0.04 MPa or higher.

At this time, the operation of the liquid suction pump 163 is suspended.

In this case, almost no liquid is allowed to flow, and the pressurized liquid is discharged from the discharge ports 102 together with air remaining in the liquid jet head 103. As a consequence, the inside of the liquid jet head 103 is wholly filled with the liquid.

In this case, even if the liquid in the sub-tank 201 is consumed due to the discharge operation, the sub-tank drawing pump 200 is continuously operated to supply the liquid from the liquid reserve tank 161 to the sub-tank 201 in an amount more than the amount of the liquid consumed by the discharge operation.

As a result, the liquid level in the sub-tank 201 is always maintained to be at a constant level.

In addition, as well as the liquid in the liquid reserve tank 161 that is continuously circulated through the in-substrate liquid path 119, the liquid that is cooled by the liquid cooling device 133 and is de-aerated is supplied to the liquid jet head 103 while being circulated through the liquid circulation paths.

With the liquid supplied as described above, the cooling of the liquid jet head 103 is effectively carried out, and further, a steady discharge operation can be carried out.

In addition, in the second embodiment, the liquid level of the sub-tank 201 is set to be at a vertical position lower than the level of the discharge ports 102 of the liquid jet head 103 by 25 mm.

Furthermore, when the liquid jet head 103 carries out neither the discharge operation nor the circulation operation of the liquid, a negative pressure of the level of −25 mm $H_2O$, which is the level appropriate to the liquid jet head 103, is applied to the discharge ports 102 of the liquid jet head 103.

Thus, even when the discharge operation is not carried out, there occurs no suction of air from the discharge ports 102 or there occurs no leakage of the liquid from the discharge ports 102.

Third Embodiment

Figure 12:
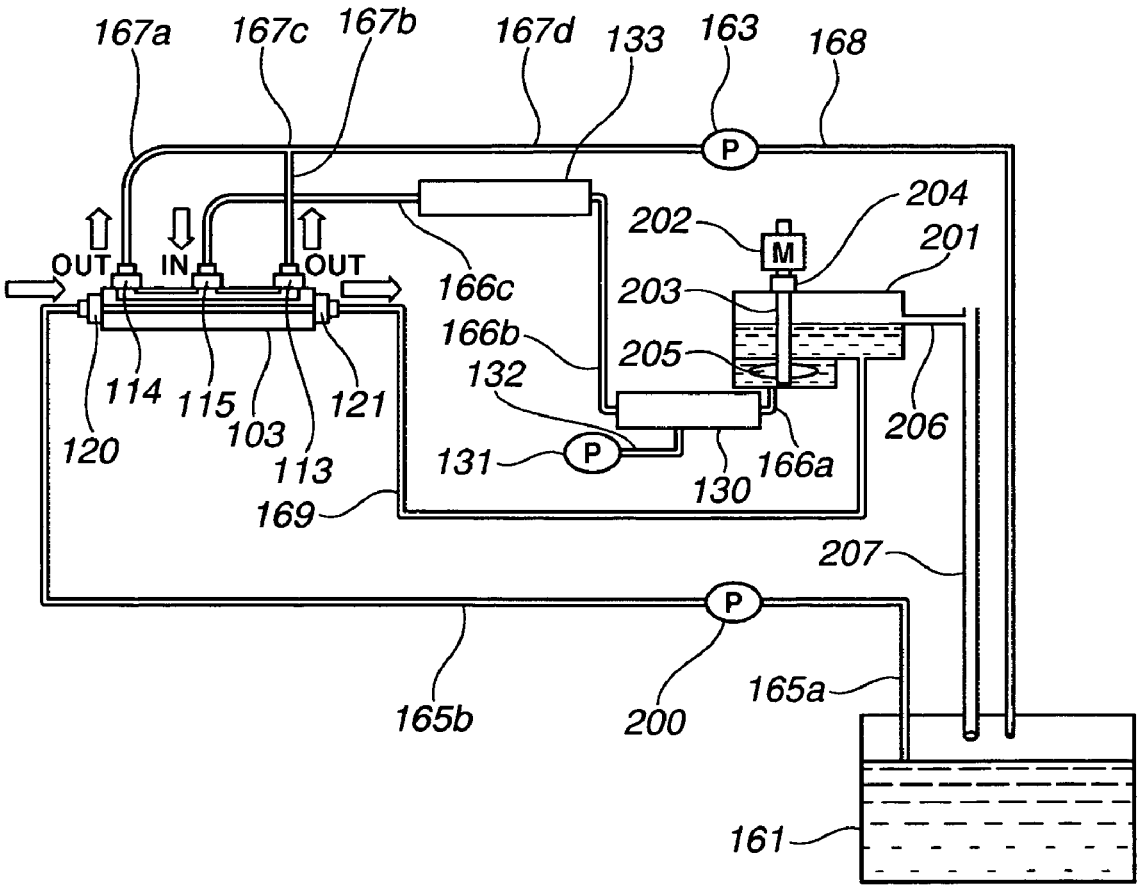
FIG. 12 is a schematic diagram showing an ink supply system of an ink jet recording apparatus according to a third embodiment of the present invention.

A liquid jet recording apparatus according to a third embodiment of the present invention is described below with reference to FIG. 12.

The third embodiment of the present invention is different from the second embodiment in the points that the de-aerating device 130 is disposed on the downstream side of the sub-tank 201 and that the front end of the tube 168 is connected to the liquid reserve tank 161. Except for these points, the configuration of the third embodiment is similar to the configuration of the second embodiment.

In the third embodiment, since the de-aerating device 130 is disposed at a position immediately close to the liquid jet head 103, it is possible to allow the capacity of the de-aerating device 130 itself and the capacity of a section including the vacuum pump 131 to be lower than those in the case of the second embodiment.

Thus, the configuration of the liquid jet recording apparatus according to the third embodiment is more suitable for a liquid jet recording apparatus that is smaller in size and is less expensive than the liquid jet recording apparatuses according to the first and second embodiments.

Figure 13:
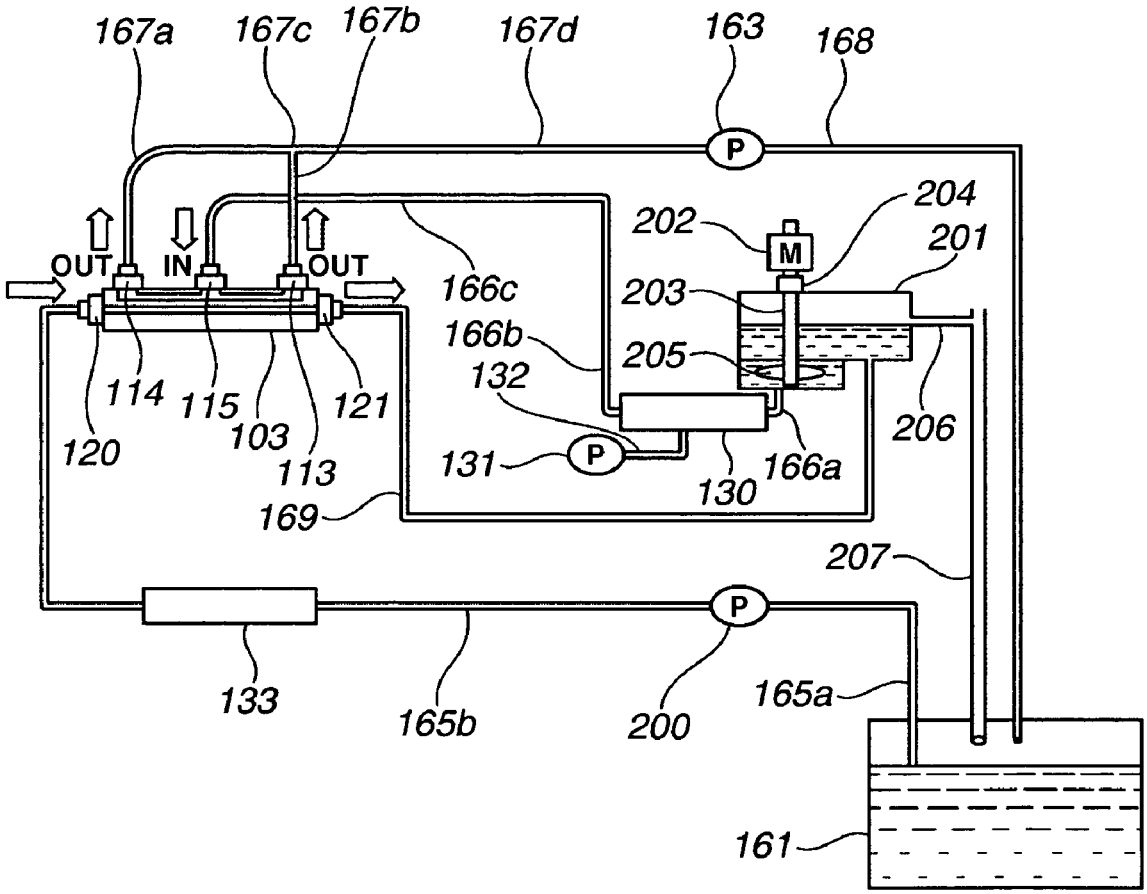
FIG. 13 is a view for explaining a cooling device of the ink supply system according to the third embodiment of the present invention.
Figure 14:
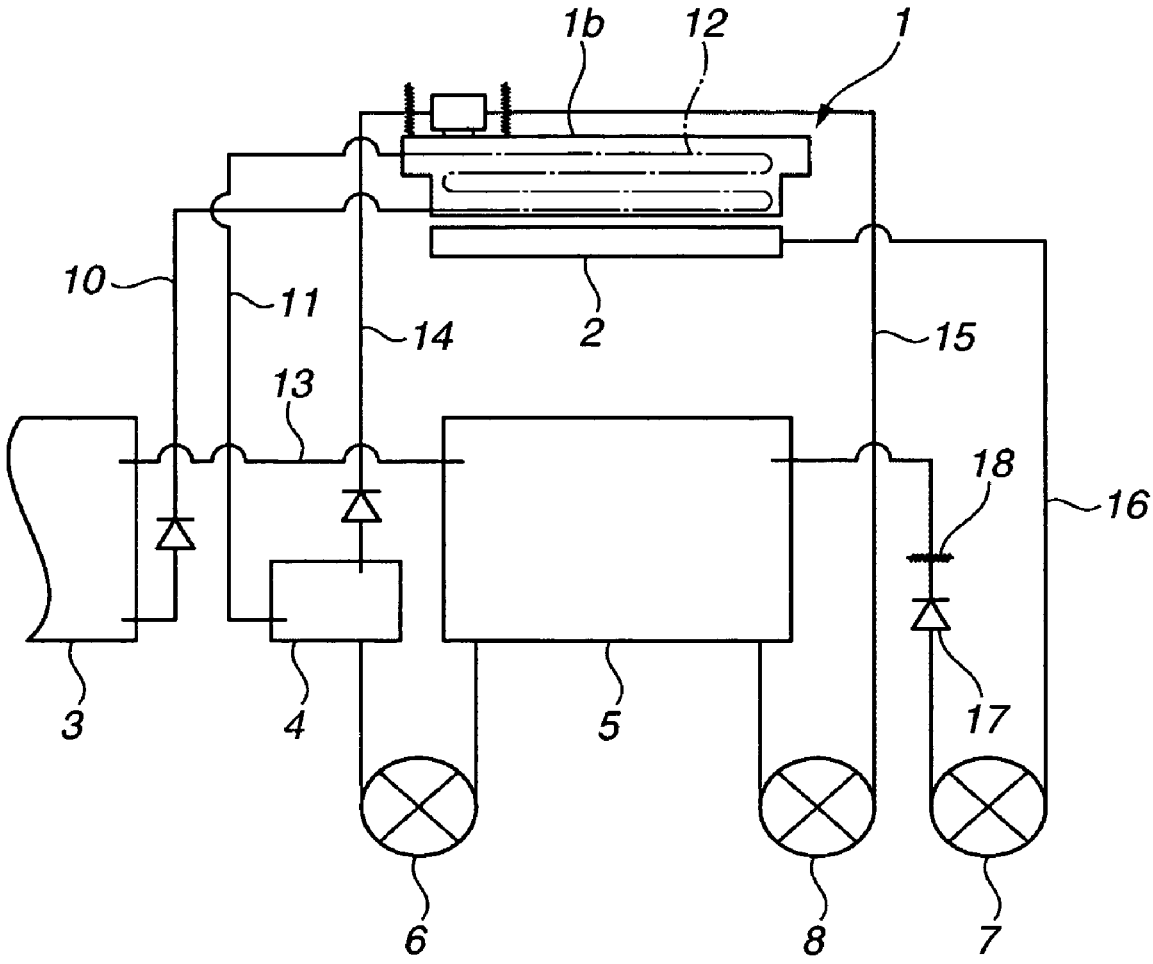
FIG.14 PRIOR ART
FIG. 14 is a schematic diagram showing a known ink supply system.
Figure 15:
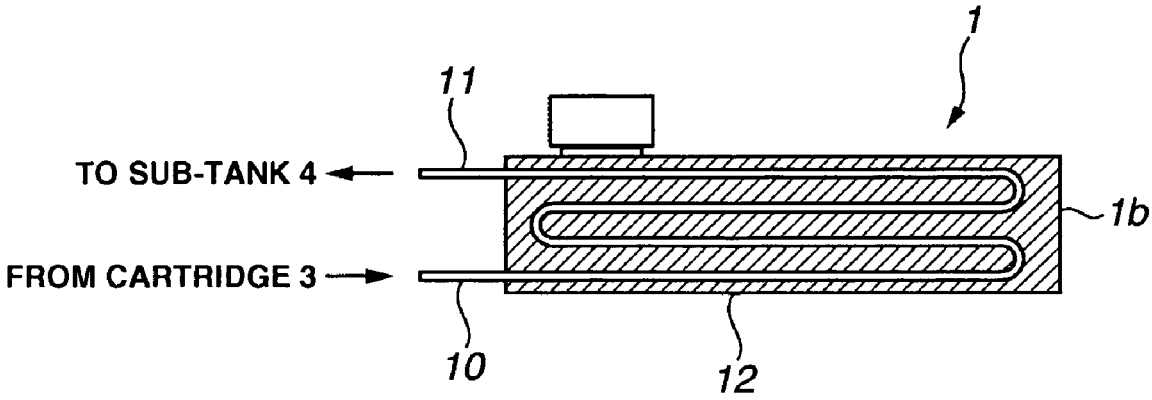
FIG.15 PRIOR ART
FIG. 15 is a cross sectional view of a known ink jet head.
Figure 16:
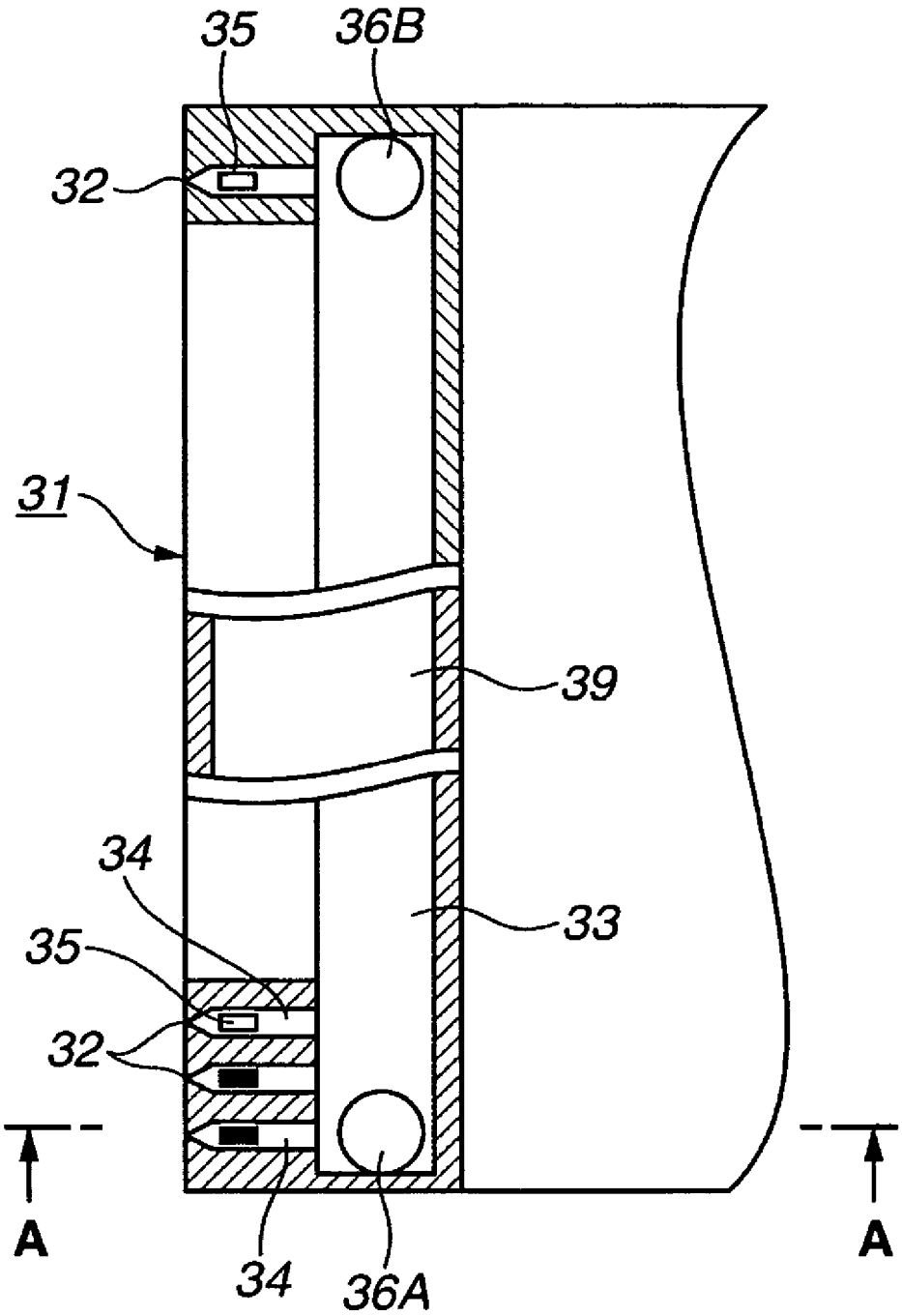
FIG.16 PRIOR ART
FIG. 16 is a cross sectional view of a known ink jet head according.
Figure 17:
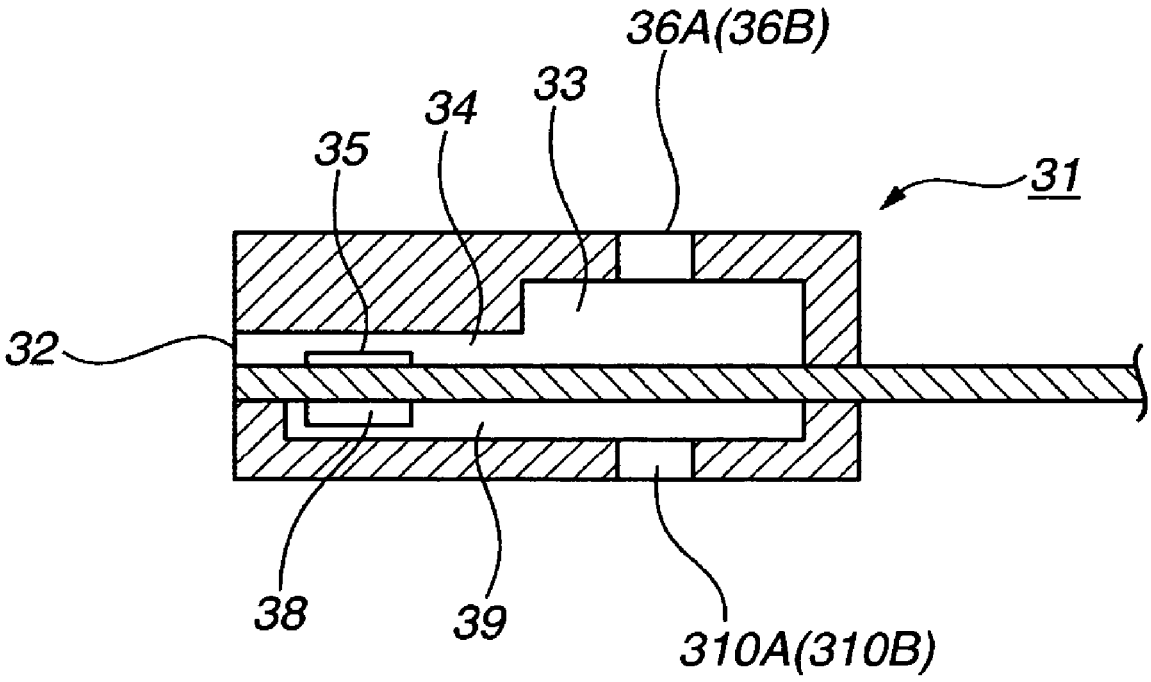
FIG.17 PRIOR ART
FIG. 17 is a cross sectional view of the ink jet head taken along line A-A of FIG. 16.
Figure 18:
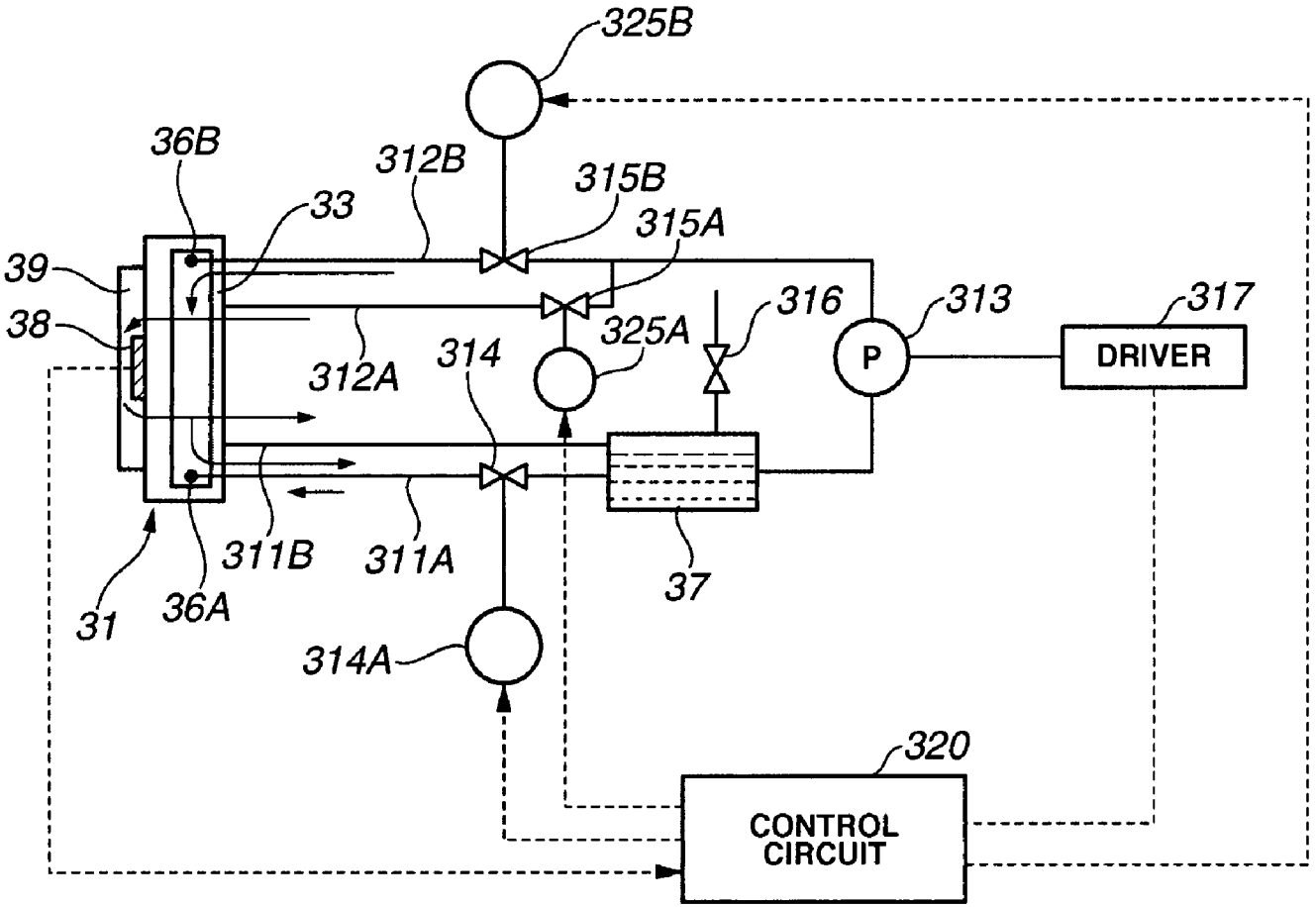
FIG.18 PRIOR ART
FIG. 18 is a schematic diagram showing a known ink supply system.

In the third embodiment, the liquid cooling device 133 is disposed between the sub-tank 201 and the liquid jet head 103. However, as shown in FIG. 13, the liquid cooling device 133 may be disposed between the liquid reserve tank 161 and the liquid jet head 103.

Thus, in the third embodiment, the rising of the temperature of the liquid jet head 103 can be reduced more effectively by lowering the temperature of the liquid before the liquid passes through the in-substrate liquid path 119.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2004-379952 filed Dec. 28, 2004, which is hereby incorporated by reference herein in its entirety.

What is claimed is:

1. A liquid jet recording apparatus comprising:

a liquid jet head including:

discharge ports configured to discharge liquid;

a plurality of element substrates each of which is provided with a plurality of energy generating elements configured to apply kinetic energy to the liquid;

a base substrate configured to support the plurality of element substrates;

a plurality of common liquid chambers provided in the base substrate and corresponding with the plurality of element substrates; and a head liquid chamber provided opposite to the plurality of element substrates across the base substrate and configured to supply the liquid to be discharged to the plurality of common liquid chambers, wherein the base substrate includes an in-substrate liquid path that is not communicated with the plurality of common liquid chambers and that has a liquid indraft orifice and a liquid outflow orifice, and wherein the head liquid chamber has at least a liquid indraft orifice and a liquid outflow orifice for the liquid to be discharged; and a liquid reserve tank and a sub-tank configured to reserve the liquid to be supplied to the liquid jet head;

a first liquid supply path that leads from the liquid reserve tank to the liquid indraft orifice provided on the base substrate via a pump;

a second liquid supply path that leads from the liquid outflow orifice provided on the base substrate to the sub-tank;

a third liquid supply path that leads from the sub-tank to the liquid indraft orifice provided on the head liquid chamber of the liquid jet head;

a fourth liquid supply path that leads from the liquid outflow orifice provided on the head liquid chamber of the liquid jet head to one of the liquid reserve tank and the sub-tank; and a fifth liquid supply path that leads from the sub-tank to the liquid reserve tank and that is configured to return the liquid from the sub-tank to the liquid reserve tank when a predetermined amount or more of the liquid is supplied from the liquid reserve tank to the sub-tank via the pump.

2. The liquid jet recording apparatus according to claim 1, further comprising:

a liquid circulation device configured to continuously allow the liquid reserved in the sub-tank to flow from the liquid indraft orifice of the head liquid chamber to the liquid outflow orifice thereof, wherein the liquid circulation device is capable of continuously circulating the liquid in the head liquid chamber even while the liquid jet head is carrying out a liquid jet operation.

3. The liquid jet recording apparatus according to claim 2, wherein an amount of circulation of the liquid circulated by the liquid circulation device is one of 5 ml/min or more, 10 ml/min or more, and 15 ml/min or more.

4. The liquid jet recording apparatus according to claim 1, wherein the pump configured to draw the liquid from the liquid reserve tank into the sub-tank is constantly operated while the liquid jet head carries out the liquid discharge operation.

5. The liquid jet recording apparatus according to claim 1, further comprising:

a de-aerating device provided in one of the first ink supply path and the second ink supply path.

6. The liquid jet recording apparatus according to claim 1, further comprising:

a liquid cooling device provided in one of the second ink supply path and the third ink supply path.

7. The liquid jet recording apparatus according to claim 1, wherein the plurality of element substrates are disposed on the base substrate in a staggered fashion.

8. The liquid jet recording apparatus according to claim 1, wherein an array of the discharge ports of the liquid jet head has a length substantially equal to a width of a recording medium.

* * * * *